US005312554A

United States Patent [19]

Waddoups et al.

[11] Patent Number: 5,312,554

[45] Date of Patent: * May 17, 1994

[54] PROCESS FOR PREPARING STABLE OLEAGINOUS COMPOSITIONS

[75] Inventors: Malcolm Waddoups; Barry J. Howlett, both of Westfield, N.J.

[73] Assignee: Exxon Chemical Patents Inc., Linden, N.J.

[ * ] Notice: The portion of the term of this patent subsequent to Jul. 3, 2007 has been disclaimed.

[21] Appl. No.: 376,120

[22] Filed: Jul. 6, 1989

Related U.S. Application Data

[63] Continuation of Ser. No. 54,288, May 26, 1987, Pat. No. 4,938,880.

[51] Int. Cl.[5] ..... C10M 137/10

[52] U.S. Cl. ..... 252/32.007 E; 252/33.004; 252/51.005 A; 252/51.005 R; 252/49.006; 252/56 R; 252/50; 252/37

[58] Field of Search ..... 252/32.7 E, 49.6, 33.4, 252/51.5 A, 51.5 R, 49.6, 50, 37

[56] References Cited

U.S. PATENT DOCUMENTS

| | | | |
|---|---|---|---|
| Re. 26,330 | 1/1968 | Colfer | 208/48 |
| 3,087,936 | 4/1963 | Le Suer | 260/326.3 |
| 3,131,150 | 4/1964 | Stuart et al. | 252/34.7 |
| 3,154,560 | 10/1964 | Osuch | 260/326.3 |
| 3,172,892 | 3/1965 | Le Suer et al. | 260/326.5 |
| 3,198,736 | 8/1965 | Hendersen | 252/46.7 |
| 3,215,707 | 11/1965 | Rense | 260/326.3 |
| 3,219,666 | 11/1965 | Norman et al. | 260/268 |
| 3,231,587 | 1/1966 | Rense | 260/346.8 |
| 3,235,484 | 2/1966 | Colfer | 208/48 |
| 3,269,946 | 8/1966 | Wiese | 252/32.5 |
| 3,272,743 | 9/1966 | Norman | 252/32.5 |
| 3,272,746 | 9/1966 | Le Suer et al. | 252/47.5 |
| 3,278,550 | 10/1966 | Norman et al. | 260/326.3 |
| 3,284,409 | 11/1966 | Derer | 252/49.9 |
| 3,284,410 | 11/1966 | Meinhardt | 252/49.6 |
| 3,288,714 | 11/1966 | Osuch | 252/57 |
| 3,346,493 | 10/1967 | Le Suer | 252/32.5 |
| 3,403,102 | 9/1968 | Le Suer | 252/49.8 |
| 3,489,682 | 1/1970 | LeSuer | 252/32.7 |
| 3,562,159 | 2/1971 | Martin | 252/32.7 |
| 3,576,743 | 4/1971 | Widmer | 252/51.5 |
| 3,632,510 | 1/1972 | Le Suer | 252/35 |
| 3,649,661 | 3/1972 | Otto | 260/429.7 |
| 3,714,042 | 1/1973 | Greenough | 252/33.2 |
| 3,793,201 | 2/1974 | Karn | 252/33.4 |
| 3,836,470 | 9/1974 | Miller | 252/51.5 A |
| 3,836,471 | 9/1974 | Miller | 252/51.5 A |
| 3,838,050 | 9/1974 | Miller | 252/40.5 |
| 3,838,052 | 9/1974 | Miller | 252/56 R |
| 3,879,308 | 4/1975 | Miller | 252/56 R |
| 3,912,764 | 10/1975 | Palmer | 260/346.8 |
| 3,927,041 | 12/1975 | Cengel et al. | 260/346.8 |

(List continued on next page.)

FOREIGN PATENT DOCUMENTS

| | | | |
|---|---|---|---|
| 895398 | 3/1972 | Canada . | |
| 0024146 | 2/1981 | European Pat. Off. . | |
| 0041851 | 12/1981 | European Pat. Off. . | |
| 00948814 | 11/1983 | European Pat. Off. . | |
| 0338540 | 7/1970 | U.S.S.R. | 252/32.7 E |
| 1368277 | 9/1974 | United Kingdom . | |
| 1398008 | 6/1975 | United Kingdom . | |

OTHER PUBLICATIONS

*Research Disclosure*, Oct. 1985, "Heat Treatment of Lubricant Additives", Disclosed anonymously, p. 25804.

*Primary Examiner*—Jacqueline V. Howard

*Attorney, Agent, or Firm*—J. B. Murray, Jr.; M. M. Allen

[57] ABSTRACT

According to the present invention, oleaginous compositions having improved stability are provided, wherein high molecular weight ashless dispersants and metal detergents are preblended at a temperature of at least 100° C. for a period of from 1 to 10 hours, cooled to at least 85° C. and admixed with additional additives, including oil soluble copper antioxidants and zinc dialkyl dithiophosphate antiwear agents.

80 Claims, No Drawings

U.S. PATENT DOCUMENTS 3,950,341 4/1976 Okamoto et al. ..... 260/268 C
3,991,056 11/1976 Okamoto et al. ..... 260/268 C
4,062,786 12/1977 Brois et al. ..... 252/51.5 R
4,105,571 8/1978 Shaub et al. ..... 252/32.7 E
4,110,349 8/1978 Cohen ..... 260/346.74
4,113,639 9/1978 Lonstrup et al. ..... 252/51.5 A
4,116,876 9/1978 Brois et al. ..... 252/49.6
4,123,373 10/1978 Brois et al. ..... 252/48.6
4,129,508 12/1978 Frihauf ..... 252/33
4,151,173 4/1979 Vogel ..... 260/326.5 F
4,195,976 4/1980 Ryer et al. ..... 44/63
4,234,435 11/1980 Meinhardt et al. ..... 252/49.9
4,244,829 1/1981 Coupland et al. ..... 252/56 R
4,253,977 3/1981 O'Halloran ..... 252/33.4
4,255,589 3/1981 Wisotsky ..... 560/198
4,278,555 7/1981 Zaweski et al. ..... 252/52 A
4,338,205 7/1982 Wisotsky ..... 252/32.5
4,411,806 10/1983 Tirtiaux et al. ..... 252/49.6
4,412,927 11/1983 Demoures et al. ..... 252/33.3
4,428,849 1/1984 Wisotsky ..... 252/33.4
4,502,970 3/1985 Schetelich ..... 252/32.7 E
4,502,971 3/1985 Robson ..... 252/33.3
4,552,677 11/1985 Hopkins ..... 252/33.6
4,664,822 5/1987 Hunt ..... 252/32.7
4,683,069 7/1987 Brewster et al. ..... 252/32.7 E
4,767,551 8/1988 Hunt et al. ..... 252/32.7 E
4,839,073 6/1989 Gutierrez ..... 252/32.7 E

PROCESS FOR PREPARING STABLE OLEAGINOUS COMPOSITIONS

CROSS REFERENCE TO RELATED APPLICATIONS

This is a Rule 60 continuation of U.S. Ser. No. 54,288, filed May 26, 1987, now U.S. Pat. No. 4,938,880.

BACKGROUND OF THE INVENTION

1. Field of the Invention

This invention relates to processes for preparing oleaginous compositions comprising oil soluble dispersant additives useful in fuel and lubricating oil compositions, including concentrates containing said additives.

2. Description of the Prior Art

Canadian Patent 895,398 discloses reacting a mole of an unsaturated hydrocarbon group of 700 to 10,000 mol. wt. with 1 to 1.5 moles of chloro-substituted maleic or fumaric acid, which material can then be further reacted with alcohol.

U.S. Pat. No. 3,927,041 discloses a mole of polybutene of 300 to 3,000 mol. wt. containing 5 to 200 ppm 1 3 dibromo-5,5-dialkylhydantoin as a catalyst reacted with 0.8 to 5, generally 1.05 to 1.15 moles of dicarboxylic acid or anhydride, to form materials which can be used per se, or as esters, amides, imides, amidines, in petroleum products.

U.S. Pat. No. 3,215,707 discloses reacting chlorine with a mixture of polyolefin up to 50,000 molecular weight, especially of 250 to 3,000 molecular weight with one or more moles of maleic anhydride depending upon whether one or more succinic anhydride radicals are to be in each polymer molecule.

U.S. Pat. No. 4,062,786 in Example 13 shows a polyisobutenylsuccinic anhydride of molecular weight of about 1300 and a Saponification Number of about 100.

U.S. Pat. Nos. 4,113,639 and 4,116,876 disclose an example of alkenyl succinic anhydride having a molecular weight of the alkenyl group of 1300 and a Saponification Number of 103 (about 1.3 succinic anhydride units per hydrocarbon molecule. This alkenyl succinic anhydride may be reacted with polyamine and then boric acid (U.S. Pat. No. 4,113,639), or may be reacted with an amino alcohol to form an oxazoline (U.S. Pat. No. 4,116,876) which is then borated by reaction with boric acid.

U.S. Pat. No. 4,123,373 in Example 3 shows a polyisobutenylsuccinic anhydride of about 1400 molecular weight having a Saponification Number of 80.

U.S. Pat. No. 4,234,435 discloses as oil additives, polyalkene substituted dicarboxylic acids derived from polyalkenes having a $\overline{M}_n$ of 1300 to 5,000 and containing at least 1.3 dicarboxylic acid groups per polyalkene.

Further related prior disclosures, which are expressly incorporated herein by reference in their entirety are U.S. Pat. Nos. 3,087,936; 3,131,150; 3,154,560; 3,172,892; 3,198,736; 3,219,666; 3,231,587; 3,235,484; 3,269,946; 3,272,743; 3,272,746; 3,278,550; 3,284,409; 3,284,410; 3,288,714; 3,403,102; 3,562,159; 3,576,743; 3,632,510; 3,836,470; 3,836,471; 3,838,050; 3,838,052; 3,879,308; 3,912,764; 3,927,041; Re. 26,330; 4,110,349; 4,113,639; 4,151,173; 4,195,976; and U.K. Pat. Nos. 1,368,277 and 1,398,008.

U.S. Pat. No. 4,412,927 relates to a process for the preparation of superalkalinized metallic dispersant-detergents for lubricating oils. The compatibility of the patentee's materials were compared to commercial products in formulations containing 2% of a dispersant having a base of polyisobutenyl succinimide, 1.6 millimoles of a zinc dithiophosphate, and 2.3% of a certain calcium or magnesium containing dispersant-detergents which were kept at 80° C. for over 25 days. No temperature of mixing these components is disclosed.

Research Disclosure 25804 (October 1985) discloses a method of preparing a reduced haze oil additive concentrate wherein an oil solution of a magnesium or calcium overbased alkylbenzene sulfonate and an oil solution of a magnesium or calcium overbased sulfurized alkylphenate are mixed and heated to a temperature of at least 80° C. (and below the boiling or decomposition temperature) for 0.25 to 10 hours, and blending the heat-treated mixture with any remaining components of the additive concentrate at a temperature not exceeding 60° C.

U.S. Pat. No. 3,649,661 relates to preparing metal complexes, having improved detergency and neutralizing characteristics for industrial fluids, by reacting an alkylene polyamine, an alkenyl succinic acid (or anhydride) and a Group IB, IIB, IVA, VIB or VIII metal salt of organo-sulfonic acids. Temperatures of 60° to 250° C. and mole ratios of metal reagent per mole of nitrogen compound of from about 0.5 to 2, are disclosed as suitable for the reaction. The patent indicates that the nitrogen compound to be reacted with the metal salt can comprise alkenyl succinic derivatives of polyamines wherein the alkenyl group contains from 8 to 300 carbon atoms, wherein the polyamine and alkenyl succinic anhydride are reacted in a mole ratio which will permit the resulting product to contain one or more basic N atoms.

U.S. Pat. No. 3,346,493 relates to lubricating compositions containing additives comprising a metal complex (Zn, Sn) of the reaction products of alkylene amines and $C_{50}$ and higher hydrocarbyl succinic acids or anhydrides, formed at temperatures of 25° C. to the decomposition point.

U.S. Pat. No. 4,502,971 relates to a process for improving the compatibility of an ashless dispersant (e.g., dispersants formed by reacting polyisobutenyl succinic anhydride and polyamine) with basic oil-soluble magnesium compounds wherein the dispersant is prereacted with a basic salt containing an alkali metal prior to mixing the dispersant with the magnesium compound to give the final additive package.

U.S. Pat. No. 3,755,172 relates to the preparation of overbased nitrogen-containing ashless dispersions, useful as lubricating oil additive, wherein a metal alkoxide-carbonate complex is added to an alcohol or alcohol-aromatic solution of a metal free, oil soluble, neutral or basic dispersing, agent containing an acylated nitrogen atom, which dispersing agent can comprise an amide, imide or ester derived from the reaction of a high molecular weight alkenyl carboxylic acid or acid anhydride with an organic nitrogen-containing compound having at least one amino group or hydroxyl group. Concurrently with, or following, addition of the alkoxide-carbonate complex, the complex is hydrolyzed to yield a dispersion of fine particles of metal carbonate. The contacting of the alkoxide-carbonate complex and dispersant solution is disclosed to be at from 25° to 100° C., and preferably 30° to 65° C.

U.S. Pat. No. 3,714,042 relates to treatment of overbased metal sulfonate detergent complexes at a temperature of from about 25° C. up to the decomposition temperature with high molecular weight carboxylic acids wherein there are at least 25 aliphatic carbon atoms per carboxy group or with anhydrides, esters, amides, imides or salt derivative of such acids. The patentee teaches that such acylated nitrogen and ester derivatives must be used at 100° to 250° C. and in a critical proportion, i.e., in an amount equivalent to at least 1 but no more than 25% of the basicity of the complex, to improve the foam and solubility properties thereof.

However, none of the foregoing suggests or discloses the heat treatment process of the present invention.

SUMMARY OF THE INVENTION

The present invention is directed to a process for producing oleaginous compositions containing high molecular weight ashless dispersants in combination with metal detergents, having improved stability properties. In accordance with the process of this invention, a high molecular weight dispersant and oil soluble metal detergent are contacted in a lubricating oil basestock at a temperature of from about 100° to 160° C. for a time from about 1 to 10 hours, which contacting can be conducted in the substantial absence of air. The resultant heat treated lubricating oil basestock liquid containing the high molecular weight dispersant and metal detergent is then cooled to a temperature of not greater than about 85° C. and admixed with copper antioxidant additives, zinc dihydrocarbyldithiophosphate anti-wear additives and other optional additives, useful in lubricating oil compositions.

In a preferred aspect, the high molecular weight dispersant comprises a polyolefin of 1300 to 5,000 number average molecular weight substituted with dicarboxylic acid producing moieties, preferably acid or anhydride moieties. This acid or anhydride material is useful per se as a dispersant additive, or this acid or anhydride material can be further reacted with amines, alcohols, including polyols, amino-alcohols, etc., to form other useful dispersant additives. The metal detergents can comprise, for example, overbased (or "basic") metal sulfonates or phenates.

Adpacks based on combinations of high molecular weight dispersants and metal detergents (e.g., the overbased sulfonates) have been found to be less stable than systems containing conventional (low molecular weight) dispersants, particularly when such adpacks also contain copper antioxidants, either alone or in combination with zinc dihydrocarbyldithiophosphate antiwear agents. This poorer stability may be noticed as phase separation during storage of the adpack.

Adpacks are usually produced by first contacting the dispersant (usually the largest percentage component in the adpack) with the detergent, generally at temperatures of up to about 85° C. We have found that the use of an elevated temperature in this contacting process under certain conditions will significantly improve the ultimate stability of the finished adpack (i.e., freedom from phase separation). This improvement in stability can offset the need for auxiliary stabilizers.

DETAILED DESCRIPTION OF THE INVENTION

Lubricating oil compositions, e.g. automatic transmission fluids, heavy duty oils suitable for gasoline and diesel engines, etc., can be prepared with the additives of the invention. Universal type crankcase oils wherein the same lubricating oil compositions can be used for both gasoline and diesel engine can also be prepared. These lubricating oil formulations conventionally contain several different types of additives that will supply the characteristics that are required in the formulations. Among these types of additives are included viscosity index improvers, antioxidants, corrosion inhibitors, detergents, dispersants, pour point depressants, antiwear agents, etc.

In the preparation of lubricating oil formulations it is common practice to introduce the additives in the form of 10 to 80 wt. %, e.g. 20 to 80 wt. % active ingredient concentrates in hydrocarbon oil, e.g. mineral lubricating oil, or other suitable solvent. Usually these concentrates may be diluted with 3 to 100, e.g. 5 to 40 parts by weight of lubricating oil, per part by weight of the additive package, in forming finished lubricants, e.g. crankcase motor oils. The purpose of concentrates, is of course, to make the handling of the various materials less difficult and awkward as well as to facilitate solution or dispersion in the final blend. Thus, a metal hydrocarbyl sulfonate or a metal alkyl phenate would be usually employed in the form of a 40 to 50 wt. % concentrate, for example, in a lubricating oil fraction. Ordinarily when preparing a lubricating oil blend that contains several types of additives no problems arise where each additive is incorporated separately in the form of a concentrate in oil. In many instances, however, the additive supplier will want to make available an additive "package" (also referred to herein as "adpacks") comprising a number of additives in a single concentrate in a hydrocarbon oil or other suitable solvent. Some additives tend to react with each other in an oil concentrate. Dispersants having a functionality (ratio) of 1.3 or higher, of the dicarboxylic acid moieties per hydrocarbon molecule have been found to interact with various other additives in packages, particularly overbased metal detergents, to cause a viscosity increase upon blending, which may be followed by a subsequent growth or increase of viscosity with time in some instances resulting in gelation of the blend. This viscosity increase can hamper pumping, blending and handling of the concentrate. While the package can be further diluted with more diluent oil to reduce the viscosity to offset the interaction effect, this dilution reduces the economy of using the package by increasing shipping, storage and other handling costs.

In Ser. No. 754,001, filed Jul. 11, 1985, oil soluble dispersant additives are disclosed wherein polyolefins of 1500 to 5000 number average molecular weight are substituted with 1.05 to 1.25 dicarboxylic acid producing moieties per polyolefin molecule. The composition therein described represents an improvement in that the hydrocarbon polymer required to maintain the oil solubility of the dispersant during engine operation can be provided with fewer acylating units per polyamine. For example, a typical dispersant derived from a polybutene acylating agent with a functionality of 1.3 or more dicarboxylic acid groups per polymer, condensed with a polyethyleneamine containing 4–7 nitrogen atoms per molecule, would require two or more acylating units per polyamine to provide sufficient oil solubility for adequate dispersancy in gasoline and diesel engines.

Dispersant-Detergent Blend Heat Treatment Process

In accordance with the process of this invention, the selected ashless dispersant, metal detergent and lubricating oil are charged to a heat treatment zone wherein the components are mixed and heated to a temperature of at least about 100° C. (e.g., from about 100° to 160° C.), preferably at least about 110° C. (e.g. , from about 110° to 140° C.), for a period of from about 1 to 10 hours, preferably from about 2 to 6 hours. At the end of the heat treatment period, the treated dispersant-detergent lube oil mixture is cooled to a temperature suitable for the subsequent intended use thereof, for example, to a temperature to at least 85° C. or below (e.g., 25° to 85° C.). It has been found that the thus heat treated dispersant-detergent lube oil mixtures exhibit surprisingly improved stability on storage, particularly when the cooled treated mixture is admixed with additional, desired additives to form an additive concentrate intended for use in admixture with a lubricating oil to form a fully formulated oil.

The dispersants and detergents can be charged to the heat treatment zone separately from, or premixed with, the lubricating oil. Alternatively, the lubricating oil can be charged to the heat treatment zone prior to, after or simultaneously with the charging of the dispersant and detergent thereto. Since the dispersant is normally the largest volume component, usually 25–50% of the adpack, the dispersant is usually charged first to cover the blades on the tank's stirrer and to therefore facilitate mixing.

It would be understood that the precise temperature and times for which the heat treatment is performed can vary depending on such factors as the particular dispersants and detergents selected, the degree of improved storage stability desired and other factors. Further, it would be understood that heat treatments at the higher of the above-identified range of temperatures will permit the time of heat treatment to be shortened from that period of time which would be used in combination with a lower heat treatment temperature, to achieve substantially equivalent stability results.

The means by which the heat treatment of this invention improves the stability of the dispersant-detergent lube oil mixture is not known, and we only require that heating times and temperatures be selected such that they are effective for improving the stability of the heat treated mixture above the stability which would be observed in the absence of such a heat treatment step. Preferably, the heat treated dispersant/detergent mixture will be substantially stable for period of at least 1 hour, more preferably at least 2 hours, and most preferably at least 3 hours, at the selected heat treatment temperature, as determined by the absence of haze and sediment formation. Still more preferably the fully formulated lubricating oil formulations prepared by admixing the heat treated dispersant/detergent mixtures prepared according to the process of this invention, with at least one of copper antioxidant material and zinc dialkyl dithiophosphate antiwear material are substantially stable at a temperature of about 54° C. for a period of at least 4; more preferably at least 10, and most preferably at least 30, days, as determined by the absence of haze and sediment. Exemplary of such improvements, and methods for illustrating the same, can be seen by reference to the examples, to be described below.

The heat treated dispersant-detergent oil mixtures of the present invention can be incorporated into a lubricating oil in any convenient way. Thus, these mixtures can be added directly to the oil by dispersing or dissolving the same in the oil at the desired level of concentrations of the dispersant and detergent, respectively. Such blending into the additional lube oil can occur at room temperature or elevated temperatures. Alternatively, the dispersant-detergent mixture can be blended with a suitable oil-soluble solvent and base oil to form a concentrate, and then blending the concentrate with a lubricating oil basestock to obtain the final formulation. Such dispersant-detergent concentrate will typically contain (on an active ingredient (A.I.) basis) from about 3 to about 45 wt. %, and preferably from about 10 to about 35 wt. %, dispersant additive, from about 3 to 45 wt. %, and preferably from about 5 to 30 wt. %, metal detergent additive, and typically from about 30 to 90 wt. %, preferably from about 40 to 60 wt. %, base oil, based on the concentrate weight. Such dispersant-detergent concentrate will typically contain (on an active ingredient basis) dispersant and detergent in a dispersant:detergent weight:weight ratio of from about 0.25:1 to 5:1, preferably from about 0.5:1 to 4.5:1, and more typically from about 0.8:1 to 4:1.

The lubricating oil basestock for the dispersant-detergent mixture typically is adapted to perform a selected function by the incorporation of additional additives therein to form lubricating oil compositions (i.e., formulations).

A. DISPERSANTS

Ashless dispersants useful in this invention comprise nitrogen or ester containing dispersants selected from the group consisting of (i) oil soluble salts, amides, imides, oxazolines and esters, or mixtures thereof, of long chain hydrocarbon substituted mono and dicarboxylic acids or their anhydrides; (ii) long chain aliphatic hydrocarbon having a polyamine attached directly thereto; and (iii) Mannich condensation products formed by condensing about a molar proportion of a long chain substituted phenol with about 1 to 2.5 moles of formaldehyde and about 0.5 to 2 moles of polyalkylene polyamine; wherein said long chain hydrocarbon group in (i), (ii) and (iii) is a polymer of a $C_2$ to $C_{10}$, e.g., $C_2$ to $C_5$, monoolefin, said polymer having a number average molecular weight of at least about 1300.

A(i) The long chain hydrocarbyl substituted mono- or dicarboxylic acid material, i.e. acid, anhydride, or ester, used in the invention includes long chain hydrocarbon, generally a polyolefin, substituted with an average of at least about 0.8,(e.g., about 0.8 to 2.0) generally from about 1.0 to 2.0, preferably 1.05 to 1.25, 1.1 to 1.2, moles per mole of polyolefin, of an alpha or beta unsaturated $C_4$ to $C_{10}$ dicarboxylic acid, or anhydride or ester thereof, such as fumaric acid, itaconic acid, maleic acid, maleic anhydride, chloromaleic acid, dimethyl fumarate, chloromaleic anhydride, acrylic acid, methacrylic acid, crotonic acid, cinnamic acid, etc.

Preferred olefin polymers for reaction with the unsaturated dicarboxylic acids are polymers comprising a major molar amount of $C_2$ to $C_{10}$, e.g. $C_2$ to $C_5$ monoolefin. Such olefins include ethylene, propylene, butylene, isobutylene, pentene, octene-1, styrene, etc. The polymers can be homopolymers such as polyisobutylene, as well as copolymers of two or more of such olefins such as copolymers of: ethylene and propylene; butylene and isobutylene; propylene and isobutylene; etc. Other copolymers include those in which a minor molar amount of the copolymer monomers, e.g., 1 to 10 mole %, is a $C_4$ to $C_{18}$ non-conjugated diolefin, e.g., a copolymer of isobutylene and butadiene; or a copolymer of ethylene, propylene and 1,4-hexadiene; etc.

In some cases, the olefin polymer may be completely saturated, for example an ethylene-propylene copolymer made by a Ziegler-Natta synthesis using hydrogen as a moderator to control molecular weight.

The olefin polymers will usually have number average molecular weights within the range of about 1300 and about 5,000, more usually between about 1300 and about 4000. Particularly useful olefin polymers have number average molecular weights within the range of about 1500 and about 3000 with approximately one terminal double bond per polymer chain. An especially useful starting material for a highly potent dispersant additive useful in accordance with this invention is polyisobutylene. The number average molecular weight for such polymers can be determined by several known techniques. A convenient method for such determination is by gel permeation chromatography (GPC) which additionally provides molecular weight distribution information, see W. W. Yau, J. J. Kirkland and D. D. Bly, "Modern Size Exclusion Liquid Chromatography", John Wiley and Sons, New York, 1979.

Processes for reacting the olefin polymer with the $C_{4-10}$ unsaturated dicarboxylic acid, anhydride or ester are known in the art. For example, the olefin polymer and the dicarboxylic acid material may be simply heated together as disclosed in U.S. Pat. Nos. 3,361,673 and 3,401,118 to cause a thermal "ene" reaction to take place. Or, the olefin polymer can be first halogenated, for example, chlorinated or brominated to about 1 to 8 wt. %, preferably 3 to 7 wt. % chlorine, or bromine, based on the weight of polymer, by passing the chlorine or bromine through the polyolefin at a temperature of 60° to 250° C., e.g. 120° to 160° C., for about 0.5 to 10, preferably 1 to 7 hours. The halogenated polymer may then be reacted with sufficient unsaturated acid or anhydride at 100° to 250° C., usually about 180° to 220° C., for about 0.5 to 10, e.g. 3 to 8 hours, so the product obtained will contain the desired number of moles of the unsaturated acid per mole of the halogenated polymer. Processes of this general type are taught in U.S. Pat. Nos. 3,087,436; 3,172,892; 3,272,746 and others.

Alternatively, the olefin polymer, and the unsaturated acid material are mixed and heated while adding chlorine to the hot material. Processes of this type are disclosed in U.S. Pat. Nos. 3,215,707; 3,231,587; 3,912,764; 4,110,349; 4,234,435; and in U.K. 1,440,219.

By the use of halogen, about 65 to 95 wt. % of the polyolefin, e.g. polyisobutylene will normally react with the dicarboxylic acid material. Upon carrying out a thermal reaction without the use of halogen or a catalyst, then usually only about 50 to 75 wt. % of the polyisobutylene will react. Chlorination helps increase the reactivity. For convenience, the aforesaid functionality ratios of dicarboxylic acid producing units to polyolefin, e.g. 1.0 to 2.0, etc. are based upon the total amount of polyolefin, that is, the total of both the reacted and unreacted polyolefin, used to make the product.

The dicarboxylic acid producing materials can also be further reacted with nucleophilic reactants selected from the group consisting of amines, alcohols, including polyols, amino-alcohols, etc., to form other useful dispersant additives. Thus, if the acid producing material is to be further reacted, e.g., neutralized, then generally a major proportion of at least 50 percent of the acid units up to all the acid units will be reacted.

Amine compounds useful as nucleophillic reactants for neutralization of the hydrocarbyl substituted dicarboxylic acid material include mono- and (preferably) polyamines, most preferably polyalkylene polyamines, of about 2 to 60, preferably 2 to 40 (e.g. 3 to 20), total carbon atoms and about 1 to 12, preferably 3 to 12, and most preferably 3 to 9 nitrogen atoms in the molecule. These amines may be hydrocarbyl amines or may be hydrocarbyl amines including other groups, e.g. hydroxy groups, alkoxy groups, amide groups, nitriles, imidazoline groups, and the like. Hydroxy amines with 1 to 6 hydroxy groups, preferably 1 to 3 hydroxy groups are particularly useful. Preferred amines are aliphatic saturated amines, including those of the general formulas:

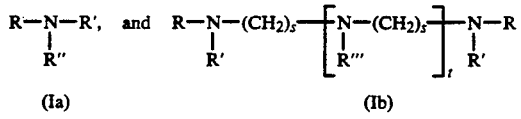

(Ia) (Ib)

wherein R, R', R'' and R''' are independently selected from the group consisting of hydrogen; $C_1$ to $C_{25}$ straight or branched chain alkyl radicals; $C_1$ to $C_{12}$ alkoxy $C_2$ to $C_6$ alkylene radicals; $C_2$ to $C_{12}$ hydroxy amino alkylene radicals; and $C_1$ to $C_{12}$ alkylamino $C_2$ to $C_6$ alkylene radicals; and wherein R''' can additionally comprise a moiety of the formula:

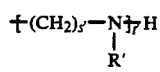

(Ic)

wherein R' is as defined above, and wherein s and s' can be the same or a different number of from 2 to 6, preferably 2 to 4; and t and t' can be the same or different and are numbers of from 0 to 10, preferably 2 to 7, and most preferably about 3 to 7, with the proviso that the sum of t and t' is not greater than 15. To assure a facile reaction, it is preferred that R, R', R'', R''', S, s', t and t' be selected in a manner sufficient to provide the compounds of Formulas Ia and Ib with typically at least one primary or secondary amine group, preferably at least two primary or secondary amine groups. This can be achieved by selecting at least one of said R, R', R'' or R''' groups to be hydrogen or by letting t in Formula Ib be at least one when R''' is H or when the Ic moiety possesses a secondary amino group. The most preferred amine of the above formulas are represented by Formula Ib and contain at least two primary amine groups and at least one, and preferably at least three, secondary amine groups.

Non-limiting examples of suitable amine compounds include: 1,2-diaminoethane; 1,3-diaminopropane; 1,4-diaminobutane; 1,6-diaminohexane; polyethylene amines such as diethylene triamine; triethylene tetramine; tetraethylene pentamine; polypropylene amines such as 1,2-propylene diamine; di-(1,2-propylene)triamine; di-(1,3-propylene) triamine; N,N-dimethyl-1,3-diaminopropane; N,N-di-(2-aminoethyl) ethylene diamine; N,N-di(2-hydroxyethyl)-1,3-propylene diamine; 3-dodecyloxypropylamine; N-dodecyl-1,3-propane diamine; tris hydroxymethylaminomethane (THAM); diisopropanol amine; diethanol amine; triethanol amine; mono-, di-, and tri-tallow amines; amino morpholines such as N-(3-aminopropyl)morpholine; and mixtures thereof.

Other useful amine compounds include: alicyclic diamines such as 1,4-di(aminomethyl) cyclohexane, and heterocyclic nitrogen compounds such as imidazolines, and N-aminoalkyl piperazines of the general formula:

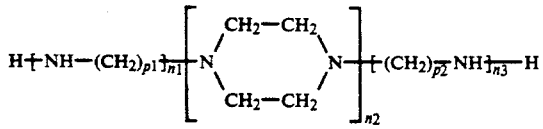

wherein $p_1$ and $p_2$ are the same or different and are each integers of from 1 to 4, and $n_1$, $n_2$ and $n_3$ are the same or different and are each integers of from 1 to 3. Non-limiting examples of such amines include 2-pentadecyl imidazoline: N-(2-aminoethyl) piperazine; etc.

Commercial mixtures of amine compounds may advantageously be used. For example, one process for preparing alkylene amines involves the reaction of an alkylene dihalide (such as ethylene dichloride or propylene dichloride) with ammonia, which results in a complex mixture of alkylene amines wherein pairs of nitrogens are joined by alkylene groups, forming such compounds as diethylene triamine, triethylenetetramine, tetraethylene pentamine and isomeric piperazines. Low cost poly(ethyleneamines) compounds averaging about 5 to 7 nitrogen atoms per molecule are available commercially under trade names such as "Polyamine H", "Polyamine 400", "Dow Polyamine E-100", etc.

Useful amines also include polyoxyalkylene polyamines such as those of the formulae:

$$NH_2\text{—alkylene}(\text{O—alkylene})_m NH_2 \quad \text{(III)}$$

where m has a value of about 3 to 70 and preferably 10 to 35; and $$R(\text{alkylene}(\text{O—alkylene})_n NH_2)_a \quad \text{(IV)}$$

where "n" has a value of about 1 to 40 with the provision that the sum of all the n's is from about 3 to about 70 and preferably from about 6 to about 35, and R is a polyvalent saturated hydrocarbon radical of up to ten carbon atoms wherein the number of substituents on the R group is represented by the value of "a", which is a number of from 3 to 6. The alkylene groups in either formula (i) or (ii) may be straight or branched chains containing about 2 to 7, and preferably about 2 to 4 carbon atoms.

The polyoxyalkylene polyamines of formulas (III) or (IV) above, preferably polyoxyalkylene diamines and polyoxyalkylene triamines, may have average molecular weights ranging from about 200 to about 4000 and preferably from about 400 to about 2000. The preferred polyoxyalkylene polyamines include the polyoxyethylene and polyoxypropylene diamines and the polyoxypropylene triamines having average molecular weights ranging from about 200 to 2000. The polyoxyalkylene polyamines are commercially available and may be obtained, for example, from the Jefferson Chemical Company, Inc. under the trade name "Jeffamines D-230, D-400, D-1000, D-2000, T-403", etc.

The amine is readily reacted with the dicarboxylic acid material, e.g. alkenyl succinic anhydride, by heating an oil solution containing 5 to 95 wt. % of dicarboxylic acid material to about 100° to 250° C., preferably 125° to 175° C., generally for 1 to 10, e.g. 2 to 6 hours until the desired amount of water is removed. The heating is preferably carried out to favor formation of imides or mixtures of imides and amides, rather than amides and salts. Reaction ratios of dicarboxylic material to equivalents of amine as well as the other neucleophilic reactants described herein can vary considerably, depending on the reactants and type of bonds formed. Generally from 0.1 to 1.0, preferably from about 0.2 to 0.6, e.g., 0.4 to 0.6, moles of dicarboxylic acid moiety content (e.g., grafted maleic anhydride content) is used per equivalent of neucleophilic reactant, e.g., amine. For example, about 0.8 mole of a pentaamine (having two primary amino groups and five equivalents of nitrogen per molecule) is preferably used to convert into a mixture of amides and imides, the product formed by reacting one mole of olefin with sufficient maleic anhydride to add 1.6 moles of succinic anhydride groups per mole of olefin, i.e., preferably the pentaamine is used in an amount sufficient to provide about 0.4 mole (that is, 1.6 divided by $(0.8\times5)$ mole) of succinic anhydride moiety per nitrogen equivalent of the amine.

The nitrogen containing dispersant can be further treated by boration as generally taught in U.S. Pat. Nos. 3,087,936 and 3,254,025 (incorporated herein by reference thereto). This is readily accomplished by treating said acyl nitrogen dispersant with a boron compound selected from the class consisting of boron oxide, boron halides, boron acids and esters of boron acids in an amount to provide from about 0.1 atomic proportion of boron for each mole of said acylated nitrogen composition to about 20 atomic proportions of boron for each atomic proportion of nitrogen of said acylated nitrogen composition. Usefully the dispersants of the inventive combination contain from about 0.05 to 2.0 wt. %, e.g. 0.05 to 0.7 wt. % boron based on the total weight of said borated acyl nitrogen compound. The boron, which appears to be in the product as dehydrated boric acid polymers (primarily $(HBO_2)_3$), is believed to attach to the dispersant imides and diimides as amine salts e.g. the metaborate salt of said diimide.

Treating is readily carried out by adding from about 0.05 to 4, e.g. 1 to 3 wt. % (based on the weight of said acyl nitrogen compound) of said boron compound, preferably boric acid which is most usually added as a slurry to said acyl nitrogen compound and heating with stirring at from about 135° C. to 190°, e.g. 140°-170° C., for from 1 to 5 hours followed by nitrogen stripping at said temperature ranges. Or, the boron treatment can be carried out by adding boric acid to the hot reaction mixture of the dicarboxylic acid material and amine while removing water.

The tris(hydroxymethyl) amino methane (THAM) can be reacted with the aforesaid acid material to form amides, imides or ester type additives as taught by U.K. 984,409, or to form oxazoline compounds and borated oxazoline compounds as described, for example, in U.S. Pat. Nos. 4,102,798; 4,116,876 and 4,113,639.

The ashless dispersants may also be esters derived from the aforesaid long chain hydrocarbon substituted dicarboxylic acid material and from hydroxy compounds such as monohydric and polyhydric alcohols or aromatic compounds such as phenols and naphthols, etc. The polyhydric alcohols are the most preferred hydroxy compound and preferably contain from 2 to about 10 hydroxy radicals, for example, ethylene glycol, diethylene glycol, triethylene glycol, tetraethylene glycol, dipropylene glycol, and other alkylene glycols in which the alkylene radical contains from 2 to about 8 carbon atoms. Other useful polyhydric alcohols include glycerol, mono-oleate of glycerol, monostearate of glycerol, monomethyl ether of glycerol, pentaerythritol, dipentaerythritol, and mixtures thereof.

The ester dispersant may also be derived from unsaturated alcohols such as allyl alcohol, cinnamyl alcohol, propargyl alcohol, 1-cyclohexane-3-ol, and oleyl alcohol. Still other classes of the alcohols capable of yielding the esters of this invention comprise the ether-alcohols and amino-alcohols including, for example, the oxy-alkylene, oxy-arylene-, amino-alkylene-, and amino-arylene-substituted alcohols having one or more oxy-alkylene, amino-alkylene or amino-arylene oxy-arylene radicals. They are exemplified by Cellosolve, Carbitol, N,N,N',N'-tetrahydroxy-trimethylene diamine, and ether-alcohols having up to about 150 oxy-alkylene radicals in which the alkylene radical contains from 1 to about 8 carbon atoms.

The ester dispersant may be diesters of succinic acids or acidic esters, i.e., partially esterified succinic acids; as well as partially esterified polyhydric alcohols or phenols, i.e., esters having free alcohols or phenolic hydroxyl radicals. Mixtures of the above illustrated esters likewise are contemplated within the scope of this invention.

The ester dispersant may be prepared by one of several known methods as illustrated for example in U.S. Pat. No. 3,381,022. The ester dispersants may also be borated, similar to the nitrogen containing dispersants, as described above.

Hydroxyamines which can be reacted with the aforesaid long chain hydrocarbon substituted dicarboxylic acid material to form dispersants include 2-amino-1-butanol, 2-amino-2-methyl-1-propanol, p-(beta-hydroxyethyl)-aniline, 2-amino-1-propanol, 3-amino-1-propanol, 2-amino-2-methyl-1, 3-propane-diol, 2-amino-2-ethyl-1, 3-propanediol, N-(beta-hydroxy-propyl)-N'-(beta-aminoethyl)-piperazine, tris(hydroxymethyl) amino-methane (also known as trismethylolaminomethane), 2-amino-1-butanol, ethanolamine, beta-(beta-hydroxyethoxy)-ethylamine, and the like. Mixtures of these or similar amines can also be employed. The above description of neucleophilic reactants suitable for reaction with the hydrocarbyl substituted dicarboxylic acid or anhydride includes amines, alcohols, and compounds of mixed amine and hydroxy containing reactive functional groups, i.e., amino-alcohols.

A preferred group of ashless dispersants are those derived from polyisobutylene substituted with succinic anhydride groups and reacted with polyethylene amines, e.g. tetraethylene pentamine, pentaethylene hexamine, polyoxyethylene and polyoxypropylene amines, e.g. polyoxypropylene diamine, trismethylolaminomethane and pentaerythritol, and combinations thereof. One particularly preferred dispersant combination involves a combination of (A) polyisobutene substituted with succinic anhydride groups and reacted with (B) a hydroxy compound, e.g. pentaerythritol, (C) a polyoxyalkylene polyamine, e.g. polyoxypropylene diamine, and (D) a polyalkylene polyamine, e.g. polyethylene diamine and tetraethylene pentamine using about 0.3 to about 2 moles each of (B) and (D) and about 0.3 to about 2 moles of (C) per mole of (A) as described in U.S. Pat. No. 3,804,763. Another preferred dispersant combination involves the combination of (A) polyisobutenyl succinic anhydride with (B) a polyalkylene polyamine, e.g. tetraethylene pentamine, and (C) a polyhydric alcohol or polyhydroxy-substituted aliphatic primary amine, e.g. pentaerythritol or trismethylolaminomethane as described in U.S. Pat. No. 3,632,511.

A(ii) Also useful as ashless dispersant in this invention are dispersants wherein a nitrogen-containing polyamine is attached directly to the long chain aliphatic hydrocarbon as shown in U.S. Pat. Nos. 3,275,554 and 3,565,804 where the halogen group on the halogenated hydrocarbon is displaced with various alkylene polyamines.

A(iii) Another class of ashless dispersants are nitrogen-containing dispersants which are those containing Mannich base or Mannich condensation products as they are known in the art. Such Mannich condensation products generally are prepared by condensing about one mole of an alkyl-substituted mono- or polyhydroxy benzene with about 1 to 2.5 moles of carbonyl compounds (e.g., formaldehyde and paraformaldehyde) and about 0.5 to 2 moles polyalkylene polyamine as disclosed, for example, in U.S. Pat. No. 3,442,808. Such Mannich condensation products may include a long chain, high molecular weight hydrocarbon (e.g., $\overline{M}n$ of 1,500 or greater) on the benzene group or may be reacted with a compound containing such a hydrocarbon, for example, polyalkenyl succinic anhydride as shown in said aforementioned U.S. Pat. No. 3,442,808, the disclosure of which is incorporated by reference in its entirety.

B. METAL DETERGENTS

Metal containing rust inhibitors and/or detergents are frequently used with ashless dispersants. Such detergents and rust inhibitors include the metal salts of sulphonic acids, alkyl phenols, sulphurized alkyl phenols, alkyl salicylates, naphthenates, and other oil soluble mono- and dicarboxylic acids. Highly basic, that is overbased metal salts which are frequently used as detergents appear particularly prone to interaction with the ashless dispersant. Usually these metal containing rust inhibitors and detergents are used in lubricating oil in amounts of about 0.01 to 10, e.g. 0.1 to 5 wt. %, based on the weight of the total lubricating composition. Marine diesel lubricating oils typically employ such metal-containing rust inhibitors and detergents in amounts of up to about 20 wt.%.

Highly basic alkaline earth metal sulfonates are frequently used as detergents. They are usually produced by heating a mixture comprising an oil-soluble sulfonate or alkaryl sulfonic acid, with an excess of alkaline earth metal compound above that required for complete neutralization of any sulfonic acid present and thereafter forming a dispersed carbonate complex by reacting the excess metal with carbon dioxide to provide the desired overbasing. The sulfonic acids are typically obtained by the sulfonation of alkyl substituted aromatic hydrocarbons such as those obtained from the fractionation of petroleum by distillation and/or extraction or by the alkylation of aromatic hydrocarbons as for example those obtained by alkylating benzene, toluene, xylene, naphthalene, diphenyl and the halogen derivatives such as chlorobenzene, chlorotoluene and chloronaphthalene. The alkylation may be carried out in the presence of a catalyst with alkylating agents having from about 3 to more than 30 carbon atoms. For example haloparaffins, olefins obtained by dehydrogenation of paraffins, polyolefins produced from ethylene, propylene, etc. are all suitable. The alkaryl sulfonates usually contain from about 9 to about 70 or more carbon atoms, preferably from about 16 to about 50 carbon atoms per alkyl substituted aromatic moiety.

The alkaline earth metal compounds which may be used in neutralizing these alkaryl sulfonic acids to provide the sulfonates includes the oxides and hydroxides, alkoxides, carbonates, carboxylate, sulfide, hydrosulfide, nitrate, borates and ethers of magnesium, calcium, and barium. Examples are calcium oxide, calcium hydroxide, magnesium acetate and magnesium borate. As noted, the alkaline earth metal compound is used in excess of that required to complete neutralization of the alkaryl sulfonic acids. Generally, the amount ranges from about 100 to 220%, although it is preferred to use at least 125%, of the stoichiometric amount of metal required for complete neutralization.

Various other preparations of basic alkaline earth metal alkaryl sulfonates are known, such as U.S. Pat. Nos. 3,150,088 and 3,150,089 wherein overbasing is accomplished by hydrolysis of an alkoxide-carbonate complex with the alkaryl sulfonate in a hydrocarbon solvent-diluent oil.

A preferred alkaline earth sulfonate additive is magnesium alkyl aromatic sulfonate having a total base number ranging from about 300 to about 400 with the magnesium sulfonate content ranging from about 25 to about 32 wt. %, based upon the total weight of the additive system dispersed in mineral lubricating oil.

Neutral metal sulfonates are frequently used as rust inhibitors. Polyvalent metal alkyl salicylate and naphthenate materials are known additives for lubricating oil compositions to improve their high temperature performance and to counteract deposition of carbonaceous matter on pistons (U.S. Pat. No. 2,744,069). An increase in reserve basicity of the polyvalent metal alkyl salicylates and naphthenates can be realized by utilizing alkaline earth metal, e.g. calcium, salts of mixtures of $C_8$–$C_{26}$ alkyl salicylates and phenates (see U.S. Pat. No. 2,744,069) or polyvalent metal salts of alkyl salicyclic acids, said acids obtained from the alkylation of phenols followed by phenation, carboxylation and hydrolysis (U.S. Pat. No. 3,704,315) which could then be converted into highly basic salts by techniques generally known and used for such conversion. The reserve basicity of these metal-containing rust inhibitors is usefully at TBN levels of between about 60 and 150. Included with the useful polyvalent metal salicylate and naphthenate materials are the methylene and sulfur bridged materials which are readily derived from alkyl substituted salicylic or naphthenic acids or mixtures of either or both with alkyl substituted phenols. Basic sulfurized salicylates and a method for their preparation is shown in U.S. Pat. No. 3,595,791. Such materials include alkaline earth metal, particularly magnesium, calcium, strontium and barium salts of aromatic acids having the general formula:

$$HOOC—ArR_1 13\ Xy(ArR_1OH)_n \quad (V)$$

where Ar is an aryl radical of 1 to 6 rings, $R_1$ is an alkyl group having from about 8 to 50 carbon atoms, preferably 12 to 30 carbon atoms (optimally about 12), X is a sulfur (—S—) or methylene (—$CH_2$—) bridge, y is a number from 0 to 4 and n is a number from 0 to 4.

Preparation of the overbased methylene bridged salicylate-phenate salt is readily carried out by conventional techniques such as by alkylation of a phenol followed by phenation, carboxylation, hydrolysis, methylene bridging a coupling agent such as an alkylene dihalide followed by salt formation concurrent with carbonation. An overbased calcium salt of a methylene bridged phenol-salicylic acid of the general formula (VI):

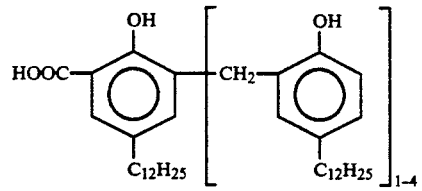

with a TBN of 60 to 150 is highly useful in this invention.

The sulfurized metal phenates can be considered the "metal salt of a phenol sulfide" which thus refers to a metal salt whether neutral or basic, of a compound typified by, the general formula (VII):

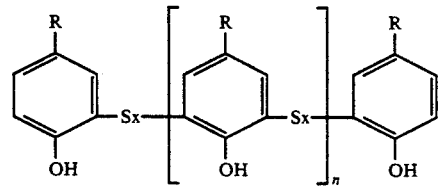

where x=1 or 2, n=0, 1 or 2 or a polymeric form of such a compound, where R is an alkyl radical, n and x are each integers from 1 to 4, and the average number of carbon atoms in all of the R groups is at least about 9 in order to ensure adequate solubility in oil. The individual R groups may each contain from 5 to 40, preferably 8 to 20, carbon atoms. The metal salt is prepared by reacting an alkyl phenol sulfide with a sufficient quantity of metal containing material to impart the desired alkalinity to the sulfurized metal phenate.

Regardless of the manner in which they are prepared, the sulfurized alkyl phenols which are useful generally contain from about 2 to about 14% by weight, preferably about 4 to about 12 wt. % sulfur based on the weight of sulfurized alkyl phenol.

The sulfurized alkyl phenol may be converted by reaction with a metal containing material including oxides, hydroxides and complexes in an amount sufficient to neutralize said phenol and, if desired, to overbase the product to a desired alkalinity by procedures well known in the art. Preferred is a process of neutralization utilizing a solution of metal in a glycol ether.

The neutral or normal sulfurized metal phenates are those in which the ratio of metal to phenol nucleus is about 1:2. The "overbased" or "basic" sulfurized metal phenates are sulfurized metal phenates wherein the ratio of metal to phenol is greater than that of stoichiometric, e.g. basic sulfurized metal dodecyl phenate has a metal content up to and greater than 100% in excess of the metal present in the corresponding normal sulfurized metal phenates wherein the excess metal is produced in oil-soluble or dispersible form (as by reaction with $CO_2$). The metal detergent can therefore comprise at least one member selected from the group consisting of overbased alkali and alkaline earth metal sulfonates, and overbased alkali and alkaline earth metal phenates.

Magnesium and calcium containing additives although beneficial in other respects can increase the tendency of the lubricating oil , to oxidize. This is especially true of the highly basic sulphonates.

According to a preferred embodiment the invention therefore provides a crankcase lubricating composition also containing from 2 to 8000 parts per million of calcium or magnesium.

The magnesium and/or calcium is generally present as basic or neutral detergents such as the sulphonates and phenates, our preferred additives are the neutral or basic magnesium or calcium sulphonates. Preferably the oils contain from 500 to 5000 parts per million of calcium or magnesium. Basic magnesium and calcium sulfonates are preferred.

C. LUBRICANT OIL BASESTOCK

The ashless dispersant and metal detergent to be heat treated in accordance with the process of the present invention will be in admixture with a lube oil basestock, comprising an oil of lubricating viscosity, including natural and synthetic lubricating oils and mixtures thereof.

Natural oils include animal oils and vegetable oils (e.g., castor, lard oil) liquid petroleum oils and hydrorefined, solvent-treated or acid-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkylbenzenes (e.g., dodecylbenzenes, tetradecylbenzenes, dinonylbenzenes, di(2-ethylhxyl)benzenes); polyphenyls (e.g., biphenyls, terphenyls, alkylated polyphenols); and alkylated diphenyl ethers and alkylated diphenyl sulfides and the derivatives, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, the alkyl and aryl ethers of these polyoxyalkylene polymers (e.g., methyl-polyisopropylene glycol ether having an average molecular weight of 1000, diphenyl ether of polyethylene glycol having a molecular weight of 500–1000, diethyl ether of polypropylene glycol having a molecular weight of 1000–1500); and mono- and polycarboxylic esters thereof, for example, the acetic acid esters, mixed $C_3$–$C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol and tripentaerythritol.

Silicon-based oils such as the polyalkyl-, polyaryl-, polyalkoxy-, or polyaryloxysiloxne oils and silicate oils comprise another useful class of synthetic lubricants; they include tetraethyl silicate, tetraisopropyl silicate, tetra-(2-ethylhexyl)silicate, tetra-(4-methyl-2-ethylhexyl)silicate, tetra-(p-tert-butylphenyl)silicate, hexa-(4-methyl-2-pentoxy)disiloxane, poly(methyl)siloxanes and poly(methylphenyl)siloxanes. Other synthetic lubricating oils include liquid esters of phosphorus-containing acids (e.g., tricresyl phosphate, trioctyl phosphate, diethyl ester of decylphosphonic acid) and polymeric tetrahydrofurans.

Unrefined, refined and rerefined oils can be used in the lubricants of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art. Rerefined oils are obtained by processes similar to those used to obtain refined oils applied to refined oils which have been already used in service. Such rerefined oils are also known as reclaimed or reprocessed oils and often are additionally processed by techniques for removal of spent additives and oil breakdown products.

ADDITIVE PACKAGES

As has been discussed above, the heat treated improved stability blends of high molecular weight ashless dispersant and metal detergent formed by the process of this invention can be admixed with one or more additional additives to form an additive package useful for blending with lube oil basestock to form the fully formulated oil.

Representative additional additives typically present in such formulations include oxidation inhibitors, viscosity modifiers, corrosion inhibitors, friction modifiers, other dispersants and detergents, anti-foaming agents, anti-wearing agents, pour point depressants, rust inhibitors and the like.

The copper antioxidants useful in this invention comprise oil soluble copper compounds. The copper may be blended into the oil as any suitable oil soluble copper compound. By oil soluble we mean the compound is oil soluble under normal blending conditions in the oil or additive package. The copper compound may be in the cuprous or cupric form. The copper may be in the form of the copper dihydrocarbyl thio- or dithio-phosphates wherein copper may be substituted for zinc in the compounds and reactions described above although one mole of cuprous or cupric oxide may be reacted with one or two moles of the dithiophosphoric acid, respectively. Alternatively the copper may be added as the copper salt of a synthetic or natural carboxylic acid.

Examples include $C_{10}$ to $C_{18}$ fatty acids such as stearic or palmitic, but unsaturated acids such as oleic or branched carboxylic acids such as naphthenic acids of molecular weight from 200 to 500 or synthetic carboxylic acids are preferred because of the improved handling and solubility properties of the resulting copper carboxylates. Also useful are oil soluble copper dithiocarbamates of the general formula $(RR'NCSS)_nCu$ (where n is 1 or 2 and R and R' are the same or different hydrocarbyl radicals containing from 1 to 18 and preferably 2 to 12 carbon atoms and including radicals such as alkyl, alkenyl, aryl, aralkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-heptyl, n-octyl, decyl, dodecyl, octadecyl, 2-ethylhexyl, phenyl, butylphenyl, cyclohexyl, methylcyclopentyl, propenyl, butenyl, etc. In order to obtain oil solubility, the total number of carbon atoms (i.e, R and R') will generally be about 5 or greater. Copper sulphonates, phenates, and acetylacetonates may also be used. The copper antioxidant can comprise a copper salt of a hydrocarbyl substituted $C_4$ to $C_{10}$ monounsaturated dicarboxylic acid producing reaction product, which reaction product is formed by reacting polymer of $C_2$ to $C_{10}$ monoolefin having a number average molecular weight of 900 to 1400 with a $C_4$ to $C_{10}$ monounsaturated acid material. Exemplary are copper salts of a hydrocarbyl substituted $C_4$ to $C_{10}$ monounsaturated dicarboxylic acid producing reaction product, which reaction product comprises a polymer of $C_2$ to $C_{10}$ monoolefin having a number average molecular weight of from 900 to 1400 substituted with succinic moieties selected from the group consisting of acid, anhydride and ester groups, wherein there is an average of about 0.8 to 1.6 molar proportions of succinic moieties per molar proportion of the polymer.

Exemplary of useful copper compounds are copper ($Cu^I$ and/or $Cu^{II}$) salts of alkenyl succinic acids or anhydrides. The salts themselves may be basic, neutral or acidic. They may be formed by reacting (a) any of the materials discussed above in the Ashless Dispersant-A(i) section, which have at least one free carboxylic acid group with (b) a reactive metal compound. Suitable reactive metal compounds include those such as cupric or cuprous hydroxides, oxides, acetates, borates, and carbonates or basic copper carbonate.

Examples of the metal salts of this invention are Cu salts of polyisobutenyl succinic anhydride (hereinafter referred to as Cu-PIBSA), and Cu salts of polyisobutenyl succinic acid. Preferably, the selected metal employed is its divalent form, e.g., $Cu^{+2}$. The preferred substrates are polyalkenyl succinic acids in which the alkenyl group has a molecular weight greater than about 700. The alkenyl group desirably has a $M_n$ from about 900 to 1400, and up to 2500, with a $M_n$ of about 950 being most preferred. Especially preferred, of those listed above in the section A(i) on Dispersants, is polyisobutylene succinic acid (PIBSA). These materials may desirably be dissolved in a solvent, such as a mineral oil, and heated in the presence of a water solution (or slurry) of the metal bearing material. Heating may take place between 70° and about 200° C. Temperatures of 110° to 140° C. are entirely adequate. It may be necessary, depending upon the salt produced, not to allow the reaction to remain at a temperature above about 140° C. for an extended period of time, e.g., longer than 5 hours, or decomposition of the salt may occur.

The copper antioxidants (e.g., Cu-PIBSA, Cu-oleate, or mixtures thereof) will be generally employed in an amount of from about 50–500 ppm by weight of the metal, in the final lubricating or fuel composition.

The copper antioxidants used in this invention are inexpensive and are effective at low concentrations and therefore do not add substantially to the cost of the product. The results obtained are frequently better than those obtained with previously used antioxidants, which are expensive and used in higher concentrations. In the amounts employed, the copper compounds do not interfere with the performance of other components of the lubricating composition, in many instances, completely satisfactory results are obtained when the copper compound is the sole antioxidant in addition to the ZDDP. The copper compounds can be utilized to replace part or all of the need for supplementary antioxidants. Thus, for particularly severe conditions it may be desirable to include a supplementary, conventional antioxidant. However, the amounts of supplementary antioxidant required are small, far less than the amount required in the absence of the copper compound.

While any effective amount of the copper antioxidant can be incorporated into the lubricating oil composition, it is contemplated that such effective amounts be sufficient to provide said lube oil composition with an amount of the copper antioxidant of from about 5 to 500 (more preferably 10 to 200, still more preferably 10 to 180, and most preferably 20 to 130 (e.g., 90 to 120)) part per million of added copper based on the weight of the lubricating oil composition. Of course, the preferred amount may depend amongst other factors on the quality of the basestock lubricating oil.

Corrosion inhibitors, also known as anti-corrosive agents, reduce the degradation of the metallic parts contacted by the lubricating oil composition. Illustrative of corrosion inhibitors are phosphosulfurized hydrocarbons and the products obtained by reaction of a phosphosulfurized hydrocarbon with an alkaline earth metal oxide or hydroxide, preferably in the presence of an alkylated phenol or of an alkylphenol thioester, and also preferably in the presence of carbon dioxide. Phosphosulfurized hydrocarbons are prepared by reacting a suitable hydrocarbon such as a terpene, a heavy petroleum fraction of a $C_2$ to $C_6$ olefin polymer such as polyisobutylene, with from 5 to 30 weight percent of a sulfide of phosphorus for ½ to 15 hours, at a temperature in the range of 150° to 600° F. Neutralization of the phosphosulfurized hydrocarbon may be effected in the manner taught in U.S. Pat. No. 1,969,324.

Oxidation inhibitors reduce the tendency of mineral oils to deteriorate in service which deterioration can be evidenced by the products of oxidation such as sludge and varnish-like deposits on the metal surfaces and by viscosity growth. Such oxidation inhibitors include alkaline earth metal salts of alkylphenolthioesters having preferably $C_5$ to $C_{12}$ alkyl side chains, calcium nonylphenol sulfide, barium t-octylphenyl sulfide, dioctylphenylamine, phenylalphanaphthylamine, phosphosulfurized or sulfurized hydrocarbons, etc.

Friction modifiers serve to impart the proper friction characteristics to lubricating oil compositions such as automatic transmission fluids.

Representative examples of suitable friction modifiers are found in U.S. Pat. No. 3,933,659 which discloses fatty acid esters and amides; U.S. Pat. No. 4,176,074 which describes molybdenum complexes of polyisobutenyl succinic anhydride-amino alkanols; U.S. Pat. No. 4,105,571 which discloses glycerol esters of dimerized fatty acids; U.S. Pat. No. 3,779,928 which discloses alkane phosphonic acid salts; U.S. Pat. No. 3,778,375 which discloses reaction products of a phosphonate with an oleamide; U.S. Pat. No. 3,852,205 which discloses S-carboxy-alkylene hydrocarbyl succinimide, S-carboxyalkylene hydrocarbyl succinamic acid and mixtures thereof; U.S. Pat. No. 3,879,306 which discloses N-(hydroxy-alkyl) alkenyl-succinamic acids or succinimides; U.S. Pat. No. 3,932,290 which discloses reaction products of di-(lower alkyl) phosphites and epoxides; and U.S. Pat. No. 4,028,258 which discloses the alkylene oxide adduct of phosphosulfurized N-(hydroxyalkyl) alkenyl succinimides. The disclosures of the above references are herein incorporated by reference. The most preferred friction modifiers are glycerol mono- and dioleates, and succinate esters, or metal salts thereof, of hydrocarbyl substituted succinic acids or anhydrides and thiobis alkanols such as described in U.S. Pat. No. 4,344,853.

Pour point depressants lower the temperature at which the fluid will flow or can be poured. Such depressants are well known. Typical of those additives which usefully optimize the low temperature fluidity of the fluid are $C_8$–$C_{18}$ dialkylfumarate vinyl acetate copolymers, polymethacrylates, and wax naphthalene.

Foam control can be provided by an antifoamant of the polysiloxane type, e.g. silicone oil and polydimethyl siloxane.

Another class of additive that can interact with ashless dispersants are the dihydrocarbyl dithiophosphate metal salts which are frequently used as anti-wear agents and which also provide antioxidant activity. The zinc salts are most commonly used in lubricating oil in amounts of 0.1 to 10, preferably 0.2 to 2 wt. %, based upon the total weight of the lubricating oil composition. They may be prepared in accordance with known techniques by first forming a dithiophosphoric acid, usually by reaction of an alcohol or a phenol with $P_2S_5$ and then neutralizing the dithiophosphoric acid with a suitable zinc compound.

Mixtures of alcohols may be used including mixtures of primary and secondary alcohols, secondary generally for imparting improved anti-wear properties, with primary giving improved thermal stability properties. Mixtures of the two are particularly useful. In general, any basic or neutral zinc compound could be used but the oxides, hydroxides and carbonates are most generally employed. Commercial additives frequently contain an excess of zinc due to use of an excess of the basic zinc compound in the neutralization reaction.

The zinc dihydrocarbyl dithiophosphates useful in the present invention are oil soluble salts of dihydrocarbyl esters of dithiophosphoric acids and may be represented by the following formula:

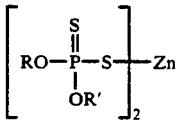

(VIII)

wherein R and R' may be the same or different hydrocarbyl radicals containing from 1 to 18, preferably 2 to 12 carbon atoms and including radicals such as alkyl, alkenyl, aryl, aralkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl etc. In order to obtain oil solubility, the total number of carbon atoms (i.e. R and R' in formula VIII) in the dithiophosphoric acid will generally be about 5 or greater. The zinc dihydrocarbyl dithiophosphate can therefore comprise zinc dialkyl dithiophosphates.

Organic, oil-soluble compounds useful as rust inhibitors in this invention comprise nonionic surfactants such as polyoxyalkylene polyols and esters thereof, and anionic surfactants such as alkyl sulfonic acids. Such anti-rust compounds are known and can be made by conventional means. Nonionic surfactants, useful as anti-rust additives in the oleaginous compositions of this invention, usually owe their surfactant properties to a number of weak stabilizing groups such as ether linkages. Nonionic anti-rust agents containing ether linkages can be made by alkoxylating organic substrates containing active hydrogens with an excess of the lower alkylene oxides (such as ethylene and propylene oxides) until the desired number of alkoxy groups have been placed in the molecule.

The preferred rust inhibitors are polyoxyalkylene polyols and derivatives thereof. This class of materials are commercially available from various sources: Pluronic Polyols from Wyandotte Chemicals Corporation; Polyglycol 112-2, a liquid triol derived from ethylene oxide and propylene oxide available from Dow Chemical Co.; and Tergitol, dodecylphenyl or monophenyl polyethylene glycol ethers, and Ucon, polyalkylene glycols and derivatives, both available from Union Carbide Corp. These are but a few of the commercial products suitable as rust inhibitors in the improved composition of the present invention.

In addition to the polyols per se, the esters thereof obtained by reacting the polyols with various carboylic acids are also suitable. Acids useful in preparing these esters are lauric acid, stearic acid, succinic acid, and alkyl- or alkenyl-substituted succinic acids wherein the alkyl-or alkenyl group contains up to about twenty carbon atoms.

The preferred polyols are prepared as block polymers. Thus, a hydroxy-substituted compound, $R-(OH)_n$(wherein n is 1 to 6, and R is the residue of a mono- or polyhydric alcohol, phenol, naphthol, etc.) is reacted with propylene oxide to form a hydrophobic base. This base is then reacted with ethylene oxide t provide a hydrophylic portion resulting in a molecule having both hydrophobic and hydrophylic portions. The relative sizes of these portions can be adjusted by regulating the ratio of reactants, time of reaction, etc., as is obvious to those skilled in the art. Thus it is within the skill of the art to prepare polyols whose molecules are characterized by hydrophobic and hydrophylic moieties which are present in a ratio rendering rust inhibitors suitable for use in any lubricant composition regardless of differences in the base oils and the presence of other additives.

If more oil-solubility is needed in a given lubricating composition, the hydrophobic portion can be increased and/or the hydrophylic portion decreased. If greater oil-in-water emulsion breaking ability is required, the hydrophylic and/or hydrophobic portions can be adjusted to accomplish this.

Compounds illustrative of $R-(OH)_n$ include alkylene polyols such as the alkylene glycols, alkylene trils, alkylene tetrols, etc., such as ethylene glycol, propylene glycol, glycerol, pentaerylthriotol, sorbitol, mannitol, and the like. Aromatic hydroxy compounds such as alkylated mono- and polyhydric phenols and naphthols can also be used, e.g., heptylphenol, dodecylphenol, etc.

Other suitable demulsifiers include the esters disclosed in U.S. Pat. Nos. 3,098,827 and 2,674,619.

The liquid polyols available from Wyandotte Chemical Co. under the name Pluronic Polyols and other similar polyols are particularly well suited as rust inhibitors. These Pluronic Polyols correspond to the formula:

$$HO-(CH_2CH_2O)_x(\underset{\underset{CH_3}{|}}{CH}CH_2O)_y(CH_2CH_2O)_zH \quad (IX)$$

wherein x,y, and z are integers greater than 1 such that the $CH_2CH_2O$ groups comprise from about 10% to about 40% by weight of the total molecular weight of the glycol, the average molecule weight of said glycol being from about 1000 to about 5000.

These products are prepared by first condensing propylene oxide with propylene glycol to produce the hydrophobic base $$HO(-\underset{\underset{CH_3}{|}}{CH}-CH_2-O)_y-H \quad (X)$$

This condensation product is then treated with ethylene oxide to add hydrophylic portions to both ends of the molecule. For best results, the ethylene oxide units should comprise from about 10 to about 40% by weight of the molecule. Those products wherein the molecular weight of the polyol is from about 2500 to 4500 and the ethylene oxide units comprise from about 10% to about 15% by weight of the molecule are particularly suitable. The polyols having a molecular weight of about 4000 with about 10% attributable to ($CH_2CH_2O$) units are particularly good. Also useful are alkoxylated fatty amines, amides, alcohols and the like, including such alkoxylated fatty acid derivatives treated with $C_9$ to $C_{16}$ alkyl-substituted phenols (such as the mono- and di-heptyl, octyl, nonyl, decyl, undecyl, dodecyl and tridecyl phenols), as described in U.S. Pat. No. 3,849,501, which is also hereby incorporated by reference in its entirety.

Viscosity modifiers impart high and low temperature operability to the lubricating oil and permit it to remain relatively viscous at elevated temperatures and also exhibit acceptable viscosity or fluidity at low temperatures. Viscosity modifiers are generally high molecular weight hydrocarbon polymers including polyesters. The viscosity modifiers may also be derivatized to include other properties or functions, such as the addition of dispersancy properties. These oil soluble viscosity modifying polymers will generally have number average molecular weights of from $10^3$ to $10^6$, preferably $10^4$ to $10^6$, e.g., 20,000 to 250,000, as determined by gel permeation chromatography or osmometry.

Examples of suitable hydrocarbon polymers include homopolymers and copolymers of two or more monomers of $C_2$ to $C_{30}$, e.g. $C_2$ to $C_8$ olefins, including both alpha-olefins and internal olefins, which may be straight or branched, aliphatic, aromatic, alkyl-aromatic, cycloaliphatic, etc. Frequently they will be of ethylene with $C_3$ to $C_{30}$ olefins, particularly preferred being the copolymers of ethylene and propylene. Other polymers can be used such as polyisobutylenes, homopolymers and copolymers of $C_6$ and higher alpha olefins, atactic polypropylene, hydrogenated polymers and copolymers and terpolymers of styrene, e.g. with isoprene and/or butadiene and hydrogenated derivatives thereof. The polymer may be degraded in molecular weight, for example by mastication, extrusion, oxidation or thermal degradation, and it may be oxidized and contain oxygen. Also included are derivatized polymers such as post-grafted interpolymers of ethylene-propylene with an active monomer such as maleic anhydride which may be further reacted with an alcohol, or amine, e.g. an alkylene polyamine or hydroxy amine, e.g. see U.S. Pat. Nos. 4,089,794; 4,160,739; 4,137,185; or copolymers of ethylene and propylene reacted or grafted with nitrogen compounds such as shown in U.S. Pat. Nos. 4,068,056; 4,068,058; 4,146,489 and 4,149,984.

The preferred hydrocarbon polymers are ethylene copolymers containing from 15 to. 90 wt. % ethylene, preferably 30 to 80 wt. % of ethylene and 10 to 85 wt. preferably 20 to 70 wt. % of one or more $C_3$ to $C_{28}$, preferably $C_3$ to $C_{18}$, more preferably $C_3$ to $C_8$, alpha-olefins. While not essential, such copolymers preferably have a degree of crystallinity of less than 25 wt. %, as determined by X-ray and differential scanning calorimetry. Copolymers of ethylene and propylene are most preferred. Other alpha-olefins suitable in place of propylene to form the copolymer, or to be used in combination with ethylene and propylene, to form a terpolymer, tetrapolymer, etc., include 1-butene, 1-pentene, 1-hexene, 1-heptene, 1-octene, 1-nonene, 1-decene, etc.; also branched chain alpha-olefins, such as 4-methyl-1-pentene, 4-methyl-1-hexene, 5-methylpentene-1, 4,4-dimethyl-1-pentene, and 6-methylheptene-1, etc., and mixtures thereof.

Terpolymers, tetrapolymers, etc., of ethylene, said $C_3$–$C_{28}$ alpha-olefin, and a non-conjugated diolefin or mixtures of such diolefins may also be used. The amount of the non-conjugated diolefin generally ranges from about 0.5 to 20 mole percent, preferably from about 1 to about 7 mole percent, based on the total amount of ethylene and alpha-olefin present.

The polyester V.I. improvers are generally polymers of esters of ethylenically unsaturated $C_3$ to $C_8$ mono- and dicarboxylic acids such as methacrylic and acrylic acids, maleic acid, maleic anhydride, fumaric acid, etc.

Examples of unsaturated esters that may be used include those of aliphatic saturated mono alcohols of at least 1 carbon atom and preferably of from 12 to 20 carbon atoms, such as decyl acrylate, lauryl acrylate, stearyl acrylate, eicosanyl acrylate, docosanyl acrylate, decyl methacrylate, diamyl fumarate, lauryl methacrylate, cetyl methacrylate, stearyl methacrylate, and the like and mixtures thereof.

Other esters include the vinyl alcohol esters of $C_2$ to $C_{22}$ fatty or mono carboxylic acids, preferably saturated such as vinyl acetate, vinyl laurate, vinyl palmitate, vinyl stearate, vinyl oleate, and the like and mixtures thereof. Copolymers of vinyl alcohol esters with unsaturated acid esters such as the copolymer of vinyl acetate with dialkyl fumarates, can also be used.

The esters may be copolymerized with still other unsaturated monomers such as olefins, e.g. 0.2 to 5 moles of $C_2$–$C_{20}$ aliphatic or aromatic olefin per mole of unsaturated ester, or per mole of unsaturated acid or anhydride followed by esterification. For example, copolymers of styrene with maleic anhydride esterified with alcohols and amines are known, e.g., see U.S. Pat. No. 3,702,300.

Such ester polymers may be grafted with, or the ester copolymerized with, polymerizable unsaturated nitrogen-containing monomers to impart dispersancy to the V.I. improvers. Examples of suitable unsaturated nitrogen-containing monomers include those containing 4 to 20 carbon atoms such as amino substituted olefins as p-(betadiethylaminoethyl)styrene; basic nitrogen-containing heterocycles carrying a polymerizable ethylenically unsatuated substituent, e.g. the vinyl pyridines and the vinyl alkyl pyridines such as 2-vinyl-5-ethyl pyridine, 2-methyl-5-vinyl pyridine, 2-vinyl-pyridine, 3-vinylpyridine, 4-vinyl-pyridine, 3-methyl-5-vinyl-pyridine, 4-methyl-2-vinyl-pyridine, 4-ethyl-2-vinyl-pyridine and 2-butyl-5-vinyl-pyridine and the like.

N-vinyl lactams are also suitable, e.g. N-vinyl pyrrolidones or N-vinyl piperidones.

The vinyl pyrrolidones are preferred and are exemplified by N-vinyl pyrrolidone, N-(1-methylvinyl) pyrrolidone, N-vinyl-5-methyl pyrrolidone, N-vinyl-3,3-dimethylpyrrolidone, N-vinyl-5-ethyl pyrrolidone, etc.

These compositions of our invention may also contain other additives such as those previously described, and other metal containing additives, for example, those containing barium and sodium.

The lubricating composition of the present invention may also include copper lead bearing corrosion inhibitors. Typically such compounds are the thiadiazole polysulphides containing from 5 to 50 carbon atoms, their derivatives and polymers thereof. Preferred materials are the derivatives of 1,3,4 thiadiazoles such as those described in U.S. Pat. Nos. 2,719,125; 2,719,126; and 3,087,932; especially preferred is the compound 2,5 bis (t-octadithio)-1,3,4 thiadiazole commercially available as Amoco 150. Other similar materials also suitable are described in U.S. Pat. Nos. 3,821,236; 3,904,537; 4,097,387; 4,107,059; 4,136,043; 4,188,299; and 4,193,882.

Other suitable additives are the thio and polythio sulphenamides of thiadiazoles such as those described in U.K. Patent Specification 1,560,830. When these compounds are included in the lubricating composition, we prefer that they be present in an amount from 0.01 to 10, preferably 0.1 to 5.0 weight percent based on the weight of the composition.

Some of these numerous additives can provide a multiplicity of effects, e.g. a dispersant-oxidation inhibitor. This approach is well known and need not be further elaborated herein.

Compositions when containing these conventional additives are typically blended into the base oil in amounts effective to provide their normal attendant function. Representative effective amounts of such additives (as the respective active ingredients) in the fully formulated oil are illustrated as follows:

When other additives are employed, it may be desirable, although not necessary, to prepare additive concentrates comprising concentrated solutions or dispersions of one or more of the dispersant, anti-rust compound and copper antioxidant used in the mixtures of this invention (in concentrate amounts hereinabove described), together with one or more of said other additives (said concentrate when constituting an additive mixture being referred to herein as an additive-package) whereby several additives can be added simultaneously to the base oil to form the lubricating oil composition. Dissolution of the additive concentrate into the lubricating oil may be facilitated by solvents and by mixing accompanied with mild heating, but this is not essential. The concentrate or additive-package will typically be formulated to contain the additives in proper amounts to provide the desired concentration in the final formulation when the additive-package is combined with a predetermined amount of base lubricant. Thus, the additive mixture of the present invention can be added to small amounts of base oil or other compatible solvents along with other desirable additives to form additive-packages containing active ingredients in collective amounts of typically from about 2.5 to about 90%, and preferably from about 15 to about 75%, and most preferably from about 25 to about 60% by weight additives in the appropriate proportions with the remainder being base oil.

The final formulations may employ typically about 10 wt. % of the additive-package with the remainder being base oil.

All of said weight percents expressed herein (unless otherwise indicated) are based on active ingredient (A.I.) content of the additive, and/or upon the total weight of any additive-package, or formulation which will be the sum of the A.I. weight of each additive plus the weight of total oil or diluent.

This invention will be further understood by reference to the following examples, wherein all parts are parts by weight, unless otherwise noted and which include preferred embodiments of the invention.

EXAMPLE 1

Preparation of Dispersant

Part A

A polyisobutenyl succinic anhydride (PIBSA) having a SA:PIB ratio of 1.04 succinic anhydride (SA) was prepared by heating a mixture of 100 parts of polyisobutylene(1725 $\overline{M}_n$) with 7.55 parts of maleic anhydride to a temperature of about 220° C. when the temperature reached 120° C., the chlorine addition was begun and 5.88 parts of chlorine at a constant rate was added to the hot mixture for about 5.5 hours. The reaction mixture was then heat soaked at 220° C. for about 1.5 hours and then stripped with nitrogen for about one hour. The resulting polyisobutenyl succinic anhydride had an ASTM Saponification Number of 64.2. The PIBSA product was 83.8 wt. % active ingredient (a.i.), the remainder being primarily unreacted PIB.

Part B

The PIBSA product of Part A was aminated and borated as follows:

1800 g of the PIBSA product having a Sap. No. of 64.2 and 1317 g of S150N lubricating oil (solvent neutral oil having a viscosity of about 150 SUS at 100° C.) was mixed in a reaction flask and heated to about 149° C. Then 121.9 g of a commercial grade of polyethyleneamine (hereinafter referred to as PAM), which was a mixture of polyethyleneamines averaging about 5 to 7 nitrogens per molecule, was added and the mixture heated to 149° C. for about one hour, followed by nitrogen stripping for about 1.5 hours. Next, 49 g of boric acid was added over about two hours while stirring and heating at 163° C., followed by two hours of nitrogen stripping, then cooling and filtering to give the final product. This product had a viscosity of 428 cs. at 100° C., a nitrogen content of 1.21 wt. %, a boron content of 0.23 wt. % and contained 49.3 wt. % of the reaction product, i.e. the material actually reacted, and 50.7 wt. % of unreacted PIB and mineral oil (S150N).

EXAMPLES 2 TO 4; COMPARATIVE EXAMPLE A

In a series of experiments, 180.6 grams of an oil solution (S150N, 50 wt. % oil) containing borated polyisobutenylsuccinic anhydride-polyamine dispersant prepared as in Example 1 and 74.1 grams of overbased magnesium sulfonate (TBN 400; containing 9.0 wt. % Mg; 48.3 wt. % in S150 diluent oil), together with an additional 47 grams of S150N oil were charged to a 600 ml. glass vessel, provided with a stirrer and heated electrically. From room temperature (about 25° C.) the charged mixture was then heated at a rate of about 2° C. per minute with stirring to the selected temperature, which was maintained for a period of 3 hours. observation of the presence or absence of haze was made at hourly intervals. The results thereby obtained are set forth in Table I.

TABLE I

| | Example No.: | | | | |
|---|---|---|---|---|---|
| | Comparative A | Comparative B | 2 | 3 | 4 |
| Temp., °C.: | 85 | 100 | 115 | 130 | 140 |
| Observations: | | | | | |
| Hour 1 | Haze | Sl. Haze | Clear | Clear | Clear |
| Hour 2 | Sl. Haze | Clear | Clear | Clear | Clear |
| Hour 3 | Clear | Clear | Clear | Clear | Clear |

Note:
"Sl. Haze" = slight haze. All observations made by visual inspection.

After the above heat treatment; each dispersant-detergent mixture was allowed to cool to a temperature of 75° C., and then the additional adpack components identified in Table II below were added, with continuous stirring for 1.5 hours to thoroughly mix all components to form the indicated adpacks. Each adpack so prepared was divided into two portions. One portion was placed in a storage vessel which was heated so as to maintain a temperature of about 54° C. The second portion was placed in a similar vessel which was heated at a temperature of about 66° C. The resulting 10 adpacks were observed to determine the presence of haze and sediment formation. The results thereby obtained are set forth below in Table III.

TABLE II

| | Wt.(1) |
|---|---|
| Zinc dialkyl dithiophosphate ("ZDDP") (containing 65 wt. % alkyl units derived from isobutyl alcohol and 35 wt. % alkyl units derived from isoamyl alcohol) (in S150N oil) | 40.2 g. |
| Nonyl phenol sulfide ("NPS") (in S150N oil) | 17.3 g. |
| Cupric oleate (in S150N oil) | 7.0 g. |

Note:
(1)all wts. as active ingredient of ZDDP, NPS and copper oleate, respectively.

TABLE III

| | Example No.: | | | | | | | | | |
|---|---|---|---|---|---|---|---|---|---|---|
| | Comparative A | | Comparative B | | 2 | | 3 | | 4 | |
| Premix Temp., °C. | 85 | | 100 | | 115 | | 130 | | 140 | |
| Storage Temp. °C. | 54 | 66 | 54 | 66 | 54 | 66 | 54 | 66 | 54 | 66 |
| Observations: | | | | | | | | | | |
| 1 | sed | sed | hz | hz | ok | ok | ok | ok | ok | ok |
| 4 days | — | — | hz | sed | ok | ok | ok | ok | ok | ok |
| 11 days | — | — | sed | — | ok | ok | ok | ok | ok | ok |
| 18 days | — | — | — | — | ok | ok | ok | ok | ok | ok |
| 25 days | — | — | — | — | ok | ok | ok | ok | ok | ok |
| 53 days | — | — | — | — | ok | ok | ok | ok | ok | ok |
| 81 days | — | — | — | — | ok | sed | ok | ok | ok | ok |
| 95 days | — | — | — | — | ok | — | ok | ok | ok | ok |
| Test terminated at 95 days. | | | | | | | | | | |

Note:
"sed" = sediment; "hz" = haze; "ok" = clear. All observations were made by visual inspection.

The foregoing data in Examples 2–4 illustrate the improved stability to sediment and haze formation observed for the fully formulated adpacks resulting from the above-described heat treatments of the high molecular weight dispersant and overbased metal sulfonate detergent pre-mix at temperatures of 115°, 130° and 140° C., compared to treatments at 85° and 100° C. in the two comparative experiments.

EXAMPLE 5

Following the procedure of Example 1, a dispersant-detergent premix was formed by mixing the indicated ashless dispersant and overbased magnesium sulfate detergent at a temperature of 100° C. for 3 hours followed by cooling to 75° C. and addition of the remaining components to form the fully formulated additive packages 5-1 through 5-5, having the compositions as set out in Table IV below. Each additive package was then stored at 66° C., as in Example 1, for observation of the number of days of storage at which haze or sediment was observed. The data thereby obtained are also set forth in Table IV.

This example illustrates the effect of copper antioxidant upon formation of sediment and haze in the additive package and particularly illustrates the shortened storage stability obtained at copper antioxidant levels of 3.0 wt. % of the cupric oleate additive, which corresponds to approximately 1200 ppm copper in the additive package.

TABLE IV

| Components | COMPOSITION (WT. %) Additive Package 5-1 | Additive Package 5-2 | Additive Package 5-3 | Additive Package 5-4 | Additive Package 5-5 |
|---|---|---|---|---|---|
| PIBSA-PAM dispersant, borated[1], overbased Mg sulfonate[2], nonyl phenol sulfide[3] and ZDDP[4] at constant ratios | 77.1 | 77.1 | 77.1 | 77.1 | 77.1 |
| Cu(oleate)$_2$[5] | 4.5 | 3.8 | 3.0 | 2.3 | 1.5 |
| S150N oil[6] | 18.4 | 19.1 | 19.9 | 20.6 | 21.4 |
| | 100.0 | 100.0 | 100.0 | 100.0 | 100.0 |
| Storage Stability, Observations[7] | Sed @ 7 days | Sed @ 7 days | Haze @ 29 days | OK @ 92 days | OK @ 92 days |

Notes:
[1]Prepared as in Example 1 (as 50 wt. % ai in S150N).
[2]As used in Example 1 (as 48.3 wt. % ai in S150N).
[3]As 65.6 wt. % ai in S150N.
[4]Zinc dialkyl dithiophosphate (as in Example 1, Table II).
[5]As 39.6 wt. % ai in S150N.
[6]Added as diluent oil.
[7]Observations made as described in Table I.

EXAMPLE 6

A separate series of runs were made in which the borated dispersant solution and overbased magnesium sulfonate detergent solution of Example 1 were blended as in that Example employing a premix temperature of 150° C. for either 1 or 2 hours of premixing, and thereafter the preheated mixtures were cooled to 75° C. and the remaining components introduced for formation of additive packages. The resulting additive packages were stored at temperatures of 66° C. and observations for haze and sediment formations were made. The results thereby obtained are summarized in Table V. These experiments show that as the length of time of blending of the detergent and dispersant increases, further improvements in storage stability of the resulting additive packages containing copper antioxidant are obtained.

TABLE V

| Components | COMPOSITION (WT. %) Additive Package D-1 | Additive Package D-2 | Additive Package D-3 | Additive Package D-4 |
|---|---|---|---|---|
| PIBSA-PAM dispersant, borated[1], | 47.0 | 47.0 | 46.6 | 46.6 |
| Overbased Mg sulfonate[2], | 18.7 | 18.7 | 18.6 | 18.6 |
| Atmos phenol sulfide[4] and ZDDP[5] at constant ratio | 1.4 | 1.4 | 2.1 | 2.1 |
| Cu(oleate)$_2$[6] | 4.2 | 4.2 | 4.2 | 4.2 |
| S150N oil[7] | 6.5 | 6.5 | 6.3 | 6.3 |
| | 100.0 | 100.0 | 100.0 | 100.0 |
| Pre-Mix Temp. (°C.) | 150 | 150 | 150 | 150 |
| Premix time (hr.) | 1 | 2 | 1 | 2 |
| Storage Stability, Observations[8] | Haze @ 45 days | OKd @ 59 days | Haze @ 17 days | Sed @ 38 days |

Notes:
[1]Prepared as in Example 1 (as 50 wt. % ai in S150N).
[2]As used in Example 1 (as 48.3 wt. % ai in S150N).
[3]Kraft Inc. (100% ai)
[4]As 65.6 wt. % ai in S150N.
[5]Zinc dialkyl dithiophosphate as used in Example 1.
[6]As 39.6 wt. % ai in S150N.
[7]Added diluent oil. [Blending performed after premix at 75° C. with stirring.]
[8]Observations made as described in Table I.

The principles, preferred embodiments, and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A process for producing dispersant-detergent compositions of improved haze-resistance, said compositions being useful as additives for oleaginous compositions which comprises:

(a) contacting a mixture comprising lubricating oil, ashless dispersant and metal detergent at a temperature of at least about 100° C. to form a heat-treated mixture;

(b) cooling said heat-treated mixture to a temperature of not greater than about 85° C. to form a cooled heat-treated mixture;

(c) admixing said cooled heat-treated mixture with at least one additional additive selected from the group consisting of oxidation inhibitors, viscosity modifiers, corrosion inhibitors, friction modifiers, dispersants, detergents, anti-foaming agents, anti-wear agents, pour point depressants and rust inhibitors to form an additive package of improved haze-resistance properties; said ashless dispersant comprising a nitrogen or ester containing dispersant selected from the group consisting of (i) oil soluble salts, amides, imides, oxazolines and esters, or mixtures thereof, of long chain hydrocarbon substituted mono and dicarboxylic acids or their anhydrides; (ii) long chain aliphatic hydrocarbon having a polyamine attached directly thereto; and (iii) Mannich condensation products formed by condensing about a molar proportion of a long chain hydrocarbon substituted phenol with about 1 to 2.5 moles of formaldehyde and about 0.5 to 2 moles of polyalkylene polyamine; wherein said long chain hydrocarbon group in (i), (ii) and (iii) is a polymer of a $C_2$ to $C_{10}$ monoolefin, said polymer having a number average molecular weight of at least about 1300.

2. The process according to claim 1, wherein said ashless dispersant, comprises the oil soluble reaction product of a reaction mixture comprising:

(a) a hydrocarbyl substituted $C_4$ to $C_{10}$ monounsaturated dicarboxylic acid producing material formed by reacting olefin polymer of $C_2$ to $C_{10}$ monoolefin having a number average molecular weight ($\overline{M}_n$) of at least about 1300 and a $C_4$ to $C_{10}$ monounsaturated acid material, said acid producing material having an average of at least about 0.8 dicarboxylic acid producing moieties per molecule of said olefin polymer present in the reaction mixture used to form said acid producing material; and (b) a nucleophilic reactant selected from the group consisting of amine, alcohol, amino alcohol and mixtures thereof.

3. The process according to claim 2, wherein the nucleophilic reactant comprises an amine.

4. The process according to claim 2, wherein said nucleophilic reactant comprises a polyethylenepolyamine.

5. The process according to claim 2, wherein the nucleophilic reactant comprises an alcohol.

6. The process according to claim 2, wherein the nucleophilic reactant comprises an amino alcohol.

7. The process according to any one of claims 3 to 6 wherein in said acid producing material there are about 0.8 to 2.0 dicarboxylic acid producing moieties per molecule of said olefin polymer.

8. The process according to claim 7, wherein said olefin polymer comprises a polymer of a $C_2$ to $C_5$ monoolefin having a molecular weight of from about 1300 to 5000 and said $C_4$ to $C_{10}$ monounsaturated acid material.

9. The process according to claim 1, wherein said additional additive comprises at least one oil soluble copper antioxidant compound.

10. The process according to claim 9, wherein said copper antioxidant compound is selected from the group consisting of copper dihydrocarbyl thiophosphates and dithiophosphates; copper salts of $C_{10}$ to $C_{18}$ fatty acids; copper salts of naphthenic acids having a molecular weight of 200 to 500, copper dithiocarbamates of the formula $(RR'NCSS)_nCu$, wherein n is 1 or 2 and R and R' are hydrocarbon radicals containing 1 to 18 carbon atoms, and a copper salt of a hydrocarbyl substituted $C_4$ to $C_{10}$ monounsaturated dicarboxylic acid producing reaction product, which reaction product is formed by reacting polymer of $C_2$ to $C_{10}$ monoolefin having a number average molecular weight of 700 to 1200 with a $C_4$ to $C_{10}$ monounsaturated acid material.

11. The process according to claim 10, wherein said copper antioxidant compound comprises a copper salt of a hydrocarbyl substituted $C_4$ to $C_{10}$ monounsaturated dicarboxylic acid producing reaction product, which reaction product comprises polymer of $C_2$ to $C_{10}$ monoolefin having a number average molecular weight of from 900 to 1400 substituted with succinic moieties selected from the group consisting of acid, anhydride and ester groups, wherein there is an average of about 0.8 to 1.6 molar proportions of succinic moieties per molar proportion of said polymer.

12. The process according to claim 4 wherein a zinc dialkyl dithiophosphate anti-wear additive is admixed with said cooled heat-treated mixture wherein each alkyl group in said zinc dialkyl dithiophosphate anti-wear additive is independently alkyl of from 2 to 8 carbon atoms.

13. The process according to claim 12 wherein said metal detergent comprises at least one member selected from the group consisting of overbased alkali and alkaline earth metal sulfonates, and overbased alkali and alkaline earth metal phenates.

14. The process according to any one of claims 4, 12 or 13 wherein a zinc dialkyl dithiophosphate antiwear additive and a copper antioxidant additive are admixed with said cooled heat-treated mixture, wherein said antioxidant comprises an oil soluble copper compound selected from the group consisting of copper dihydrocarbyl thiophosphates and dithiophosphates; copper salts of $C_{10}$ to $C_{18}$ fatty acids; copper salts of naphthenic acids having a molecular weight of 200 to 500, copper dithiocarbamates of the formula $(RR'NCSS)_nCu$, wherein n is 1 or 2 and R and R' are hydrocarbon radicals containing 1 to 18 carbon atoms, and a copper salt of a hydrocarbyl substituted $C_4$ to $C_{10}$ monounsaturated dicarboxylic acid producing reaction product, which reaction product is formed by reacting polymer of $C_2$ to $C_{10}$ monoolefin having a number average molecular weight of 900 to 1400 with a $C_4$ to $C_{10}$ monounsaturated acid material.

15. The process according to claim 1, wherein said lubricating oil, ashless dispersant and metal detergent are contacted in the substantial absence of air.

16. The process according to claim 2, wherein said metal detergent comprises at least one member selected from the group consisting of neutral and overbased alkali and alkaline earth metal sulfonates, and neutral and overbased alkali and alkaline earth metal phenates.

17. The process according to claim 16, wherein said metal detergent comprises at least one member selected from the group consisting of overbased magnesium sulfonates, overbased calcium sulfonates, overbased calcium phenates, overbased magnesium phenates, neutral calcium phenates, neutral magnesium phenates, neutral calcium sulfonates and neutral magnesium sulfonates.

18. The process according to any one of claims 1, 16 or 17 wherein said dispersant and detergent are contacted in a ratio of from about 0.25 to 5 parts by weight of said dispersant per part by weight of said detergent.

19. The process according to claim 18 wherein said step (a) contacting is effected at a temperature of from about 100° to 160° C.

20. The process according to claim 18 wherein said dispersant comprises a borated nitrogen-containing dispersant.

21. A process for producing dispersant-detergent compositions of improved haze-resistance, said compositions being useful as additives for oleaginous compositions which comprises:

(a) contacting a mixture comprising lubricating oil, ashless dispersant and metal detergent at a temperature of at least about 100° C. to 160° C. to form a heat-treated mixture;

(b) cooling said heat-treated mixture to a temperature of not greater than about 85° C. to form a cooled heat-treated mixture;

(c) admixing said cooled heat-treated mixture with at least one additional additive selected from the group consisting of oxidation inhibitors, viscosity modifiers, corrosion inhibitors, friction modifiers, dispersants, detergents, anti-foaming agents, anti-wear agents, pour point depressants and rust inhibitors to form an additive package of improved haze-resistance properties; said ashless dispersant comprising the oil soluble reaction product of a reaction mixture comprising: (i) a hydrocarbyl substituted $C_4$ to $C_{10}$ monounsaturated dicarboxylic acid producing material formed by reacting olefin polymer of $C_2$ to $C_{10}$ monoolefin having a number average molecular weight of at least about 1300 and a $C_4$ to $C_{10}$ monounsaturated acid material, said acid producing material having an average of at least about 0.8 dicarboxylic acid producing moieties per molecule of said olefin polymer present in the reaction mixture used to form said acid producing material; and (ii) a nucleophilic reactant selected from the group consisting of amine, alcohol, amino alcohol and mixtures thereof; and said metal detergent comprises at least one member selected from the group consisting of neutral and overbased alkali and alkaline earth metal sulfonates, and neutral and overbased alkali and alkaline earth metal phenates.

22. The process according to claim 21, wherein the nucleophilic reactant comprises an amine.

23. The process according to claim 21, wherein said nucleophilic reactant comprises a polyethylenepolyamine.

24. The process according to any one of claims 22 or 23 wherein in said acid producing material there are about 0.8 to 2.0 dicarboxylic acid producing moieties per molecule of said olefin polymer.

25. The process according to claim 24, wherein said olefin polymer comprises a polymer of a $C_2$ to $C_4$ monoolefin having a molecular weight of from about 1300 to 5000.

26. The process according to claim 25, wherein said additional additive comprises at least one oil soluble copper antioxidant compound.

27. The process according to claim 26, wherein said copper antioxidant compound is selected from the group consisting of copper dihydrocarbyl thiophosphates and dithiophosphates; copper salts of $C_{10}$ to $C_{18}$ fatty acids; copper salts of naphthenic acids having a molecular weight of 200 to 500, copper dithiocarbamates of the formula $(RR'NCSS)_nCu$, wherein n is 1 or 2 and R and R' are hydrocarbon radicals containing 1 to 18 carbon atoms, and a copper salt of a hydrocarbyl substituted $C_4$ to $C_{10}$ monounsaturated dicarboxylic acid producing reaction product, which reaction product is formed by reacting polymer of $C_2$ to $C_{10}$ monoolefin having a number average molecular weight of 700 to 1200 with a $C_4$ to $C_{10}$ monounsaturated acid material.

28. The process according to claim 27, wherein said copper antioxidant compound comprises a copper salt of a hydrocarbyl substituted $C_4$ to $C_{10}$ monounsaturated dicarboxylic acid producing reaction product, which reaction product comprises polymer of $C_2$ to $C_{10}$ monoolefin having a number average molecular weight of from 900 to 1400 substituted with succinic moieties selected from the group consisting of acid, anhydride and ester groups, wherein there is an average of about 0.8 to 1.6 molar proportions of succinic moieties per molar proportion of said polymer.

29. The process according to claim 21 wherein said additional additive comprises at least one zinc dialkyl dithiophosphate anti-wear additive wherein each alkyl group is independently alkyl of from 2 to 10 carbon atoms.

30. The process according to claim 29 wherein said additional additive comprises both said zinc dialkyl dithiophosphate antiwear additive and an antioxidant, wherein said antioxidant comprises an oil soluble copper compound selected from the group consisting of copper dihydrocarbyl thiophosphates and dithiophosphates; copper salts of $C_{10}$ to $C_{18}$ fatty acids; copper salts of naphthenic acids having a molecular weight of 200 to 500, copper dithiocarbamates of the formula $(RR'NCSS)_nCu$, wherein n is 1 or 2 and R and R' are hydrocarbon radicals containing 1 to 18 carbon atoms, and a copper salt of a hydrocarbyl substituted $C_4$ to $C_{10}$ monounsaturated dicarboxylic acid producing reaction product, which reaction product is formed by reacting polymer of $C_2$ to $C_{10}$ monoolefin having a number average molecular weight of 900 to 1400 with a $C_4$ to $C_{10}$ monounsaturated acid material.

31. The process according to claim 21 wherein said metal detergent comprises at least one member selected from the group consisting of overbased magnesium sulfonates, overbased calcium sulfonates, overbased calcium phenates, overbased magnesium phenates, neutral calcium phenates, neutral magnesium phenates, neutral calcium sulfonates and neutral magnesium sulfonates.

32. The process according to claim 21, wherein said dispersant and detergent are contacted in a ratio of from about 0.25 to 5 parts by weight of said dispersant per part by weight of said detergent.

33. The process according to claim 23 wherein said dispersant comprises a borated nitrogen containing dispersant.

34. The process according to claim 9 wherein said copper antioxidant compound comprises copper sulfonate.

35. The process according to claim 26 wherein said copper antioxidant compound comprises copper sulfonate.

36. The process according to any one of claims 1–6, 9, 10 to 13, 15 to 17 or 34 wherein said step (a) contacting is effected at a temperature of at least 110° C. to form said heat-treated mixture.

37. The process according to claim 7 wherein said step (a) contacting is effected at a temperature of at least 110° C. to form said heat-treated mixture.

38. The process according to claim 14 wherein said step (a) contacting is effected at a temperature of at least 110° C. to form said heat-treated mixture.

39. The process according to claim 19 wherein said step (a) contacting is effected at a temperature of from about 110° to 140° C.

40. The process according to any one of claims 21 to 23 or 29 to 33 wherein said step (a) contacting is effected at a temperature of at from about 110° to 140° C.

41. The process according to claim 24 wherein said step (a) contacting is effected at a temperature of from about 110° to 140° C.

42. The process according to claim 21 wherein said ashless dispersant comprises an ester dispersant.

43. The process according to claim 42 wherein said ester dispersant is borated.

44. The process according to any one of claims 42 or 43 wherein said nucleophilic reactant comprises a polyhydric alcohol.

45. The process according to any one of claims 9, 10, 11 or 34 wherein said additive package is added to lubricating oil to form a final lubricating composition containing from about 50 to 500 parts per million of added copper in the form of said oil soluble copper compound.

46. The process according to claim 45 wherein said final lubricating composition contains from 10 to 120 parts per million of said added copper.

47. The process according to any one of claims 21 to 23 or 29 to 32 wherein said additive package is added to lubricating oil to form a final lubricating composition containing from about 50 to 500 parts per million of added copper in the form of said oil soluble copper compound.

48. The process according to claim 47 wherein said final lubricating composition contains from 10 to 120 parts per million of said added copper.

49. A process for producing dispersant-detergent compositions of improved haze-resistance, said compositions being useful as additives for oleaginous compositions which comprises:

(a) contacting a mixture comprising lubricating oil, ashless dispersant and metal detergent at a temperature of at least about 100° C. for a time to form a heat-treated mixture;

(b) cooling said heat-treated mixture to a temperature of not greater than about 85° C. to form a cooled heat-treated mixture;

(c) admixing said cooled heat-treated mixture with at least one member selected from the group consisting of copper antioxidant additives and zinc dialkyl dithiophosphate anti-wear additives to form an additive package of improved haze-resistance properties; said ashless dispersant comprising the oil soluble reaction product of a reaction mixture comprising:

(i) a hydrocarbyl substituted $C_4$ to $C_{10}$ monounsaturated dicarboxylic acid producing material formed by reacting olefin polymer of $C_2$ to $C_{10}$ monoolefin having a number average molecular weight ($\overline{M}_n$) of from about 1,500 to 3,000 and a $C_4$ to $C_{10}$ monounsaturated acid material, said acid producing material having an average of at least about 0.8 dicarboxylic acid producing moieties per molecule of said olefin polymer present in the reaction mixture used to form said acid producing material; and (ii) a nucleophilic reactant selected from the group consisting of amine, alcohol, amino alcohol and mixtures thereof.

50. The process according to claim 49, wherein the nucleophilic reactant comprises an amine.

51. The process according to claim 49, wherein said nucleophilic reactant comprises a polyethylenepolyamine.

52. The process according to claim 49, wherein the nucleophilic reactant comprises an alcohol.

53. The process according to claim 49, wherein the nucleophilic reactant comprises an amino alcohol.

54. The process according to claim 49, wherein said olefin polymer comprises a polymer of a $C_2$ to $C_5$ monoolefin.

55. The process according to claim 49, wherein said antioxidant comprises at least one oil soluble copper antioxidant compound.

56. The process according to claim 55, wherein said copper antioxidant compound is selected from the group consisting of copper dihydrocarbyl thiophosphates and dithiophosphates; copper salts of $C_{10}$ to $C_{18}$ fatty acids; copper salts of naphthenic acids having a molecular weight of 200 to 500, copper dithiocarbamates of the formula $(RR'NCSS)_nCu$, wherein n is 1 or 2 and R and R' are hydrocarbon radicals containing 1 to 18 carbon atoms, and a copper salt of a hydrocarbyl substituted $C_4$ to $C_{10}$ monounsaturated dicarboxylic acid producing reaction product, which reaction product is formed by reacting polymer of $C_2$ to $C_{10}$ monoolefin having a number average molecular weight of 700 to 1200 with a $C_4$ to $C_{10}$ monounsaturated acid material.

57. The process according to claim 56, wherein said copper antioxidant compound comprises a copper salt of a hydrocarbyl substituted $C_4$ to $C_{10}$ monounsaturated dicarboxylic acid producing reaction product, which reaction product comprises polymer of $C_2$ to $C_{10}$ monoolefin having a number average molecular weight of from 900 to 1400 substituted with succinic moieties selected from the group consisting of acid, anhydride and ester groups, wherein there is an average of about 0.8 to 1.6 molar proportions of succinic moieties per molar proportion of said polymer.

58. The process according to claim 55 wherein said copper antioxidant compound comprises copper sulfonate.

59. The process according to claim 51 wherein a zinc dialkyl dithiophosphate anti-wear additive is admixed with said cooled heat-treated mixture wherein each alkyl group in said zinc dialkyl dithiophosphate anti-wear additive is independently alkyl of from 2 to 8 carbon atoms.

60. The process according to claim 59 wherein said metal detergent comprises at least one member selected from the group consisting of overbased alkali and alkaline earth metal sulfonates, and overbased alkali and alkaline earth metal phenates.

61. The process according to any one of claims 51, 59 or 60 wherein both said zinc dialkyl dithiophosphate antiwear additive and said copper antioxidant additive are admixed with said cooled heat-treated mixture, wherein said antioxidant comprises an oil soluble copper compound selected from the group consisting of copper dihydrocarbyl thiophosphates and dithiophosphates; copper salts of $C_{10}$ to $C_{18}$ fatty acids; copper sulfonate; copper salts of naphthenic acids having a molecular weight of 200 to 500, copper dithiocarbamates of the formula $(RR'NCSS)_nCu$, wherein n is 1 or 2 and R and R' are hydrocarbon radicals containing 1 to 18 carbon atoms, and a copper salt of a hydrocarbyl substituted $C_4$ to $C_{10}$ monounsaturated dicarboxylic acid producing reaction product, which reaction product is formed by reacting polymer of $C_2$ to $C_{10}$ monoolefin having a number average molecular weight of 900 to 1400 with a $C_4$ to $C_{10}$ monounsaturated acid material.

62. The process according to claim 49, wherein said lubricating oil, ashless dispersant and metal detergent are contacted in the substantial absence of air.

63. The process according to claim 49, wherein said metal detergent comprises at least one member selected from the group consisting of neutral and overbased alkali and alkaline earth metal sulfonates, and neutral and overbased alkali and alkaline earth metal phenates.

64. The process according to claim 63 wherein said metal detergent comprises at least one member selected from the group consisting of overbased magnesium sulfonates, overbased calcium sulfonates, overbased calcium phenates, overbased magnesium phenates, neutral calcium phenates, neutral magnesium phenates, neutral calcium sulfonates and neutral magnesium sulfonates.

65. The process according to any one of claims 49, 63 or 64 wherein said dispersant and detergent are contacted in a ratio of from about 0.25 to 5 parts by weight of said dispersant per part by weight of said detergent.

66. The process according to claim 65 wherein said step (a) contacting is effected at a temperature of from about 100° to 160° C.

67. The process according to claim 65 wherein said dispersant comprises a borated nitrogen-containing dispersant.

68. A method of improving the compatibility of oil soluble nitrogen- or ester-containing ashless lube oil dispersants and basic magnesium-containing detergents intended for incorporation in a DI package concentrate which will contain other lube oil additive ingredients, said method comprising the steps of:

(1) preparing a mixture comprising (a) the dispersant; (b) the detergent; and (c) a substantially inert solvent; and (2) blending said mixture at a temperature within the range of about 100° to about 160° C. for a period of time sufficient to render the mixture substantially free of haze and sediment, said method being subject to the proviso that the mixture prepared in step (1) be free of other additive ingredients susceptible to thermal decomposition in the blending step (2) wherein said dispersant comprises a succinimide and said detergent comprises an overbased magnesium alkylbenzene sulfonate.

69. The method of claim 68 wherein the magnesium detergent is an overbased magnesium sulfonate having a TBN of about 300 to about 400.

70. The method of claim 68 wherein the ashless dispersant is a borated or non-borated succinimide dispersant.

71. The method of claim 68 wherein the amount of ashless dispersant present in the mixture prepared in step (1) is less than the total amount of said ashless dispersant intended for incorporation in said DI package.

72. The method of claim 68 wherein the blending of step (2) is carried out at a temperature of about 110° C. to about 140° C. for a period of about 1 to about 10 hours.

73. The method of claim 68 wherein the mixture prepared in step (1) consists essentially of said dispersant, detergent and solvent.

74. A method for preparing a lubricating oil DI additive package comprising an oil soluble nitrogen or ester containing lube oil ashless dispersant, a basic magnesium containing detergent and one or more additional additives for imparting oxidation resistance and wear resistance wherein the ashless dispersant and the basic magnesium detergent exhibit improved compatibility in the package, said method comprising the steps of:

(1) preparing a mixture comprising (a) the dispersant; (b) the detergent; and (c) a substantially inert solvent;

(2) blending said mixture at a temperature within the range of about 100° to about 160° C. for a period of time sufficient to render the mixture substantially free of haze and sediment; said mixture prepared in step (1) being essentially free of other additive ingredients susceptible to thermal decomposition in said blending step of (2); and (3) incorporating said other additives into the blended haze and sediment free mixture wherein said dispersant comprises a succinimide and said detergent comprises an overbased magnesium alkylbenzene sulfonate.

75. The method of claim 74 wherein the magnesium detergent is an overbased magnesium sulfonate having a TBN of about 300 to about 400.

76. The method of claim 75 wherein the ashless dispersant is a borated or non-borated succinimide dispersant.

77. The method of claim 74 wherein the amount of ashless dispersant present in the mixture prepared in step (1) is less than the total amount of said ashless dispersant intended for incorporation in said DI package.

78. The method of claim 74 wherein the blending of step (2) is carried out at a temperature of about 110° C. to about 140° C. for a period of about 1 to about 10 hours.

79. The method of claim 74 wherein the mixture prepared in step (1) consists essentially of the dispersant, the detergent and the solvent.

80. A method for improving the compatibility of oil soluble nitrogen or ester containing lube oil ashless dispersants and basic magnesium sulfonate detergent in DI packages incorporating these materials plus other additives imparting properties comprising oxidation resistance and wear resistance, said method comprising:

(1) preparing a mixture in which there is measurable haze and sediment, said mixture consisting essentially of (a) a magnesium sulfonate detergent having a TBN of about 300 to 400; and (b) a borated or nonborated ashless dispersant consisting of a succinimide dispersant; and (c) substantially inert solvent; and (2) blending said mixture at a temperature of about 100° C. to about 160° C. for a period of time sufficient to render the mixture substantially free of said haze and sediment.

* * * * *